US011022923B2

(12) United States Patent
Igo et al.

(10) Patent No.: US 11,022,923 B2
(45) Date of Patent: Jun. 1, 2021

(54) IMAGE FORMING APPARATUS, AND METHOD FOR CONTROLLING THE SAME

(71) Applicant: KONICA MINOLTA, INC., Tokyo (JP)

(72) Inventors: Shota Igo, Toyokawa (JP); Masahiro Kamiya, Toyohashi (JP); Katsuyuki Ikuta, Hamamatsu (JP); Toshio Tsuboi, Okazaki (JP); Tatsuya Eguchi, Toyohashi (JP)

(73) Assignee: Konica Minolta, Inc., Tokyo (JP)

( * ) Notice: Subject to any disclaimer, the term of this patent is extended or adjusted under 35 U.S.C. 154(b) by 310 days.

(21) Appl. No.: 16/202,789

(22) Filed: Nov. 28, 2018

(65) Prior Publication Data

US 2019/0196381 A1 Jun. 27, 2019

(30) Foreign Application Priority Data

Dec. 22, 2017 (JP) ..... JP2017-246356

(51) Int. Cl.
*G03G 15/00* (2006.01)

(52) U.S. Cl.
CPC ..... *G03G 15/5062* (2013.01); *G03G 15/5029* (2013.01); *G03G 15/553* (2013.01); *G03G 15/6502* (2013.01)

(58) Field of Classification Search
CPC ..... G03G 15/5029
See application file for complete search history.

(56) References Cited

U.S. PATENT DOCUMENTS

2007/0047979 A1* 3/2007 Ai ..... G03G 15/6508 399/23
2011/0058882 A1* 3/2011 Umeda ..... B41J 11/009 400/582
2011/0279876 A1* 11/2011 Okano ..... G03G 15/234 358/498
2017/0357199 A1* 12/2017 Minamino ..... G03G 15/55

FOREIGN PATENT DOCUMENTS

JP 2000247465 A 9/2000
JP 2007055814 A 3/2007
JP 2016141562 A 8/2016

* cited by examiner

*Primary Examiner* — Jennifer Bahls
(74) *Attorney, Agent, or Firm* — Buchanan Ingersoll & Rooney PC

(57) ABSTRACT

An image forming apparatus includes: a housing part that is capable of housing a plurality of recording materials in such a manner that one recording material is put on another; a transport part that transports a recording material from the housing part; and a hardware processor that detects a kind of the recording material transported by the transport part, detects an amount of the recording materials housed in the housing part, detects replacement of recording materials housed in the housing part, or addition of recording materials in the housing part, on the basis of a result of the detection by the hardware processor, and, on the basis of a result of the detection by the hardware processor, switches whether or not to execute, by the hardware processor, the kind detection of the recording materials housed in the housing part.

24 Claims, 24 Drawing Sheets

FIG. 8

| ORDER OF RECORDING MATERIAL IN PAPER FEED CASSETTE (FROM BOTTOM) | KIND INFORMATION | AMOUNT INFORMATION |
|---|---|---|
| 1 | | |
| 2 | | |
| 3 | | |
| 4 | | |

FIG. 10

| ORDER OF RECORDING MATERIAL IN PAPER FEED CASSETTE (FROM BOTTOM) | KIND INFORMATION | AMOUNT INFORMATION |
|---|---|---|
| 1 | KIND A | HEIGHT L0 TO HEIGHT L1 |
| 2 | | |
| 3 | | |
| 4 | | |

FIG. 12

| ORDER OF RECORDING MATERIAL IN PAPER FEED CASSETTE (FROM BOTTOM) | KIND INFORMATION | AMOUNT INFORMATION |
|---|---|---|
| 1 | KIND A | HEIGHT L0 TO HEIGHT L1 |
| 2 | KIND B | HEIGHT L1 TO HEIGHT L2 |
| 3 | | |
| 4 | | |

FIG. 16

| ORDER OF RECORDING MATERIAL IN PAPER FEED CASSETTE (FROM BOTTOM) | KIND INFORMATION | AMOUNT INFORMATION |
|---|---|---|
| 1 | KIND A | HEIGHT L0 TO HEIGHT L2 |
| 2 | | |
| 3 | | |
| 4 | | |

FIG. 18

| ORDER OF RECORDING MATERIAL IN PAPER FEED CASSETTE (FROM BOTTOM) | KIND INFORMATION | AMOUNT INFORMATION |
|---|---|---|
| 1 | KIND A | HEIGHT L0 TO HEIGHT L1 |
| 2 | KIND B | HEIGHT L1 TO HEIGHT L3 |
| 3 | | |
| 4 | | |

FIG. 20

| ORDER OF RECORDING MATERIAL IN PAPER FEED CASSETTE (FROM BOTTOM) | KIND INFORMATION | AMOUNT INFORMATION |
|---|---|---|
| 1 | KIND A | HEIGHT L0 TO HEIGHT L3 |
| 2 | | |
| 3 | | |
| 4 | | |

IMAGE FORMING APPARATUS, AND METHOD FOR CONTROLLING THE SAME

The entire disclosure of Japanese patent Application No. 2017-246356, filed on Dec. 22, 2017, is incorporated herein by reference in its entirety.

BACKGROUND

Technological Field

The present invention relates to an image forming apparatus, and a method for controlling the image forming apparatus. More specifically, the present invention relates to an image forming apparatus that detects a kind of a recording material, and a method for controlling the image forming apparatus.

Description of the Related Art

Electrophotographic image forming apparatuses include a multi function peripheral (MFP), a facsimile apparatus, a copying machine, and a printer, the MFP being provided with a scanner function, a facsimile function, a copy function, a function as a printer, a data communication function, and a server function.

As recording materials used in an image forming apparatus, there are various recording materials each having various characteristics with respect to basic weight, size, permeability, rigidity, smoothness and the like. In order to achieve high image quality, it is necessary to perform printing under the most suitable conditions corresponding to a kind of recording materials.

With respect to the image forming apparatuses in the prior art, when a cassette of the image forming apparatus is replenished with recording materials, a user is required to set a kind of recording materials through an operation panel, a personal computer (PC) or the like. The image forming apparatus forms a high-quality image by selecting image forming conditions (transport speed of recording material, development conditions, transfer conditions, fixing conditions, image processing or the like) that are the most suitable for the set kind of recording materials. However, the difficulty and inconvenience of a method for setting a kind of recording materials may lead to incorrect setting of the kind of recording materials, which causes the occurrence of an image failure, a fixing failure, a paper jam or the like.

Accordingly, there is proposed a technology in which physical properties such as the thickness, permeability or smoothness of recording materials are detected by using a sensor provided in the image forming apparatus, and a kind of recording materials is automatically detected on the basis of a result of the detection.

JP 2007-55814 A discloses an image forming apparatus comprising: a feeding part provided with a housing part for housing recording materials; a recording material detection part that detects a kind of a plurality of recording materials fed from the feeding part; and a control part that determines the kind of recording materials on the basis of a result of the detection of the kind of the plurality of recording materials. In the image forming apparatus, after the kind of recording materials has been determined, the control part controls the recording material detection part so as not to detect the recording materials fed from the feeding part.

JP 2000-247465 A discloses an image forming apparatus comprising: a tray insertion and removal sensor that detects insertion and removal of a tray; a paper kind detection sensor that detects a kind of paper transported from a tray to an image forming part in copy operation; and a control part. According to detection results from the tray insertion and removal sensor and the paper kind detection sensor, the control part stores the kind of paper before insertion and removal of the tray, and the kind of paper after insertion of the tray in a random access memory (RAM). When switching of paper before the copy operation, or during the copy operation, is recognized according to a kind of paper detected by the paper kind detection sensor, a kind of paper before insertion and removal of the tray stored in the RAM, and a kind of paper after insertion of the tray, the control part stops the operation of an image input part or an image forming part, or notifies an operation part of a warning message, thereby preventing miscopying.

JP 2016-141562 A discloses an image forming apparatus in which a time period during which a paper feed cassette is opened is calculated from a time period from the start-up of a timer until the timer stops, and a determination is made as to whether or not the time period during which the paper feed cassette is opened is longer than the minimum prediction time (the timeout time) required to replenish or replace sheets of paper in the paper feed cassette. When the time period during which the paper feed cassette is opened is longer than the timeout time, the image forming apparatus determines whether or not a weight change detection notification has been input from a weight change detection sensor, and in a case where it is determined that the weight change detection notification has been input, the image forming apparatus displays a paper setting screen on a liquid crystal display part.

In the technology disclosed in JP 2007-55814 A, after the kind of recording materials is determined on the basis of the result of detecting the kind of the plurality of recording materials, the determination of a kind of paper is omitted. This avoids the necessity for kind detection of all of the recording materials to be transported, and therefore a decrease in productivity is suppressed.

Meanwhile, in the technology of JP 2007-55814 A, after the kind of recording materials has been determined, in a case where recording materials, the kind of which differs from the kind of recording materials housed in the paper feed cassette before the addition, are added in the paper feed cassette, image formation is performed for the newly added recording materials under conditions suitable for the kind of recording materials housed before the addition. In addition, after the kind of recording materials has been determined, in a case where recording materials housed in the paper feed cassette are replaced, image formation is performed for recording materials after the replacement under conditions suitable for the kind of recording materials before the replacement. This leads to a situation in which image formation is performed under conditions that are not suitable for target recording materials, and there arises a problem that an image failure, a fixing failure, a paper jam or the like will occur.

In the technology of JP 2000-247465 A, processing carried out when switching of paper is recognized is only stopping the operation of the image input part or the image forming part, or notifying the operation part of a warning message. Therefore, user's operation is required when new paper is set. Accordingly, there arises a problem that in a case where replacement or addition of recording materials has been performed, user's operation is complicated.

SUMMARY

The present invention has been made to solve the above-mentioned problems, and an object of the present invention is to provide an image forming apparatus that is capable of, while avoiding complication of user's operation, correctly detecting a kind of recording materials, and to provide a method for controlling the image forming apparatus.

To achieve the abovementioned object, according to an aspect of the present invention, an image forming apparatus reflecting one aspect of the present invention comprises: a housing part that is capable of housing a plurality of recording materials in such a manner that one recording material is put on another; a transport part that transports a recording material from the housing part; and a hardware processor that detects a kind of the recording material transported by the transport part, detects an amount of the recording materials housed in the housing part, detects replacement of recording materials housed in the housing part, or addition of recording materials in the housing part, on the basis of a result of the detection by the hardware processor, and, on the basis of a result of the detection by the hardware processor, switches whether or not to execute, by the hardware processor, the kind detection of the recording materials housed in the housing part.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 8 is a drawing illustrating contents of a kind table obtained in a case where a recording material presence/absence detection sensor has detected absence of a recording material in the first embodiment of the present invention;

FIG. 10 is a drawing illustrating a state (first state) after update of the kind table obtained in a case where all of the recording materials M replenished in the paper feed cassette have been identified as "kind A" in FIG. 9;

FIG. 12 is a drawing illustrating a state (second state) after update of the kind table obtained in a case where the recording materials added in the paper feed cassette have been identified as "kind B" in FIG. 11;

FIG. 16 is a drawing illustrating a state after update of the kind table obtained in a case where the recording materials added in the paper feed cassette have been identified as "kind A" in FIG. 15;

FIG. 18 is a drawing illustrating a state after update of the kind table obtained in a case where the paper feed cassette shifts from the second state to the state shown in FIG. 17 after the partial extraction of recording materials is completed;

FIG. 20 is a drawing illustrating a state after update of the kind table obtained in a case where the paper feed cassette shifts from the second state to the state shown in FIG. 19 after the partial extraction of recording materials is completed;

DETAILED DESCRIPTION OF EMBODIMENTS

Hereinafter, one or more embodiments of the present invention will be described with reference to the drawings. However, the scope of the invention is not limited to the disclosed embodiments.

Image forming apparatuses in the embodiments described below include, for example, a MFP, an ink jet printer, a laser printer, a copying machine, or a facsimile.

First Embodiment (Configuration of Image Forming Apparatus)

Figure 1:
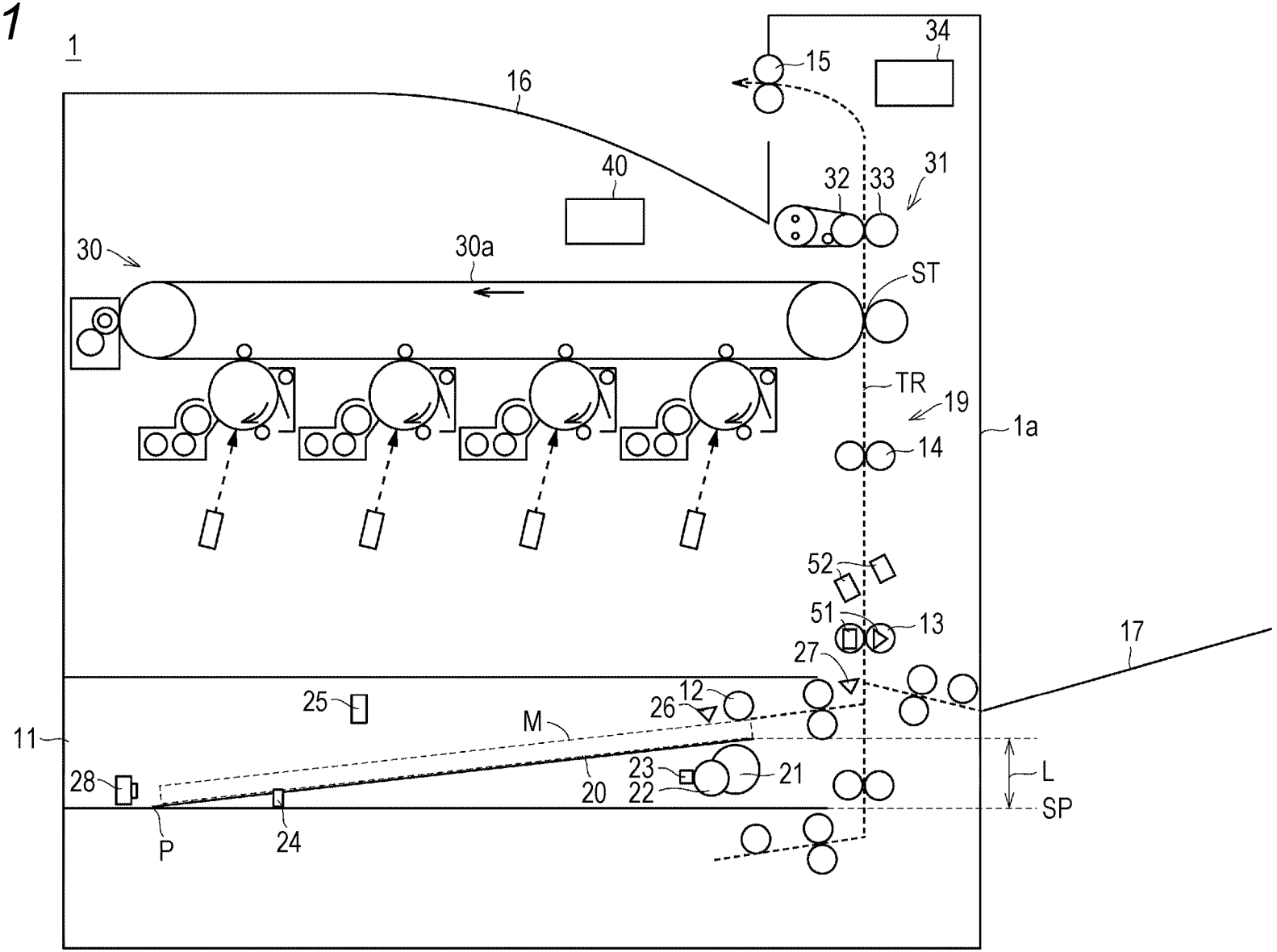
FIG. 1 is a cross-sectional view schematically illustrating a configuration of an image forming apparatus according to a first embodiment of the present invention.

FIG. 1 is a cross-sectional view schematically illustrating a configuration of the image forming apparatus 1 according to the first embodiment of the present invention.

Referring to FIG. 1, the image forming apparatus 1 according to the present embodiment is mainly provided with the paper feed cassette 11 (an example of a housing part), a manual feed tray 17, a recording material transport part 19 (an example of a transport part), a toner image formation part 30, a fixing device 31, an operation panel 34 (an example of a warning part and a display part), a control part 40, an optical sensor 51, and an ultrasonic sensor 52.

The paper feed cassette 11 and the manual feed tray 17 are each capable of housing a plurality of recording materials M, each of which is used to form an image thereon, in such a manner that one recording material is put on another. Two or more paper feed cassettes 11 may be provided. A manual feeding recording material used to form an image thereon can be arranged in the manual feed tray 17.

The recording material transport part 19 transports recording materials (print media) M from the paper feed cassette 11 (or the manual feed tray 17) one by one along a transport path TR. The recording material transport part 19 includes paper feed rollers 12, transport rollers 13, resist rollers 14, paper discharge rollers 15, and a paper discharge tray 16. The paper feed rollers 12 are provided between each of the paper feed cassette 11 and the manual feed tray 17 and the transport path TR. The transport rollers 13 and the resist rollers 14 are provided along the transport path TR. The paper discharge rollers 15 are provided in the most downstream part of the transport path TR. The paper discharge tray 16 is provided on the top of the image forming apparatus main body 1*a*.

The toner image formation part 30 synthesizes an image having four colors of Y (yellow), M (magenta), C (cyan) and K (black), and forms a toner image on the recording material M at a printing position ST. The toner image formation part 30 includes an intermediate transfer belt 30*a*. In addition, the toner image formation part 30 includes a photoreceptor drum, a charging roller, an exposing device, a developing device, a primary transfer roller, and a secondary transfer roller.

The fixing device 31 transports a recording material, which carries a toner image, along the transport path TR while holding the recording material, thereby fixing the toner image on the recording material M. The fixing device 31 includes a heating roller 32, and a pressure roller 33. The heating roller 32 and the pressure roller 33 come in contact with each other so as to form a fixing nip. The heating roller 32 is heated by a well-known Induction Heating (IH) or halogen heater, or the like. The heating roller 32 rotates by being driven by the rotation of the pressure roller 33.

The operation panel 34 displays various kinds of information, and accepts inputs of various kinds of information.

The control part 40 controls operation of the image forming apparatus 1 as a whole. The control part 40 includes: a Central Processing Unit (CPU) that executes a control program; a Read Only Memory (ROM) that stores the control program and the like; a RAM that forms a work area of the CPU; and a Hard Disk Drive (HDD) that stores various kinds of information.

The optical sensor 51 and the ultrasonic sensor 52 detect physical properties of a recording material by using methods that differ from each other under the control of the control part 40. The optical sensor 51 has a detection position near the transport roller 13. The ultrasonic sensor 52 is provided on the more downstream side of the transport path TR than the optical sensor 51, and has a detection position between the transport roller 13 and the resist roller 14. Each of the optical sensor 51 and the ultrasonic sensor 52 may have any detection position on the more upstream side of the transport path TR than the printing position ST.

The image forming apparatus 1 feeds the recording materials M housed in the paper feed cassette 11 (or the manual feed tray 17) to the transport path TR one by one by the paper feed rollers 12, and guides the recording material M to the printing position ST along the transport path TR by the transport rollers 13 and the resist rollers 14. The image forming apparatus 1 temporarily stops the recording material M by using the resist rollers 14, and then transports the recording material M to the printing position ST in accordance with the timing of printing by the toner image formation part 30.

Meanwhile, by well-known electrophotographic and tandem systems, the image forming apparatus 1 uses the toner image formation part 30 to generate a toner image on the intermediate transfer belt 30*a*, and transports the toner image toward the printing position ST by the rotation of the intermediate transfer belt 30*a*. The recording material M is sent from the resist roller 14 to the printing position ST, and the toner image is transported from the toner image formation part 30 to the printing position ST. The image forming apparatus 1 transfers the toner image from the intermediate transfer belt 30*a* to the recording material M at the printing position ST.

The image forming apparatus 1 uses the fixing device 31 to heat and pressurize the recording material M on which the toner image has been formed. As the result, the toner image is fixed on the recording material M. Subsequently, the image forming apparatus 1 feeds the recording material M, on which the toner image has been fixed, toward the paper discharge rollers 15, and discharges the recording material M to the paper discharge tray 16 by the paper discharge roller 15.

User's operation causes the paper feed cassette 11 to change between an opened state in which the recording material can be put in and out and a closed state in which the recording material cannot be put in and out. The paper feed cassette 11 includes a lifter 20, a motor 21, an encoder 22, a rotation detection sensor 23, a recording material presence/absence detection sensor 24, an opening and closing detection sensor 25, an upper limit detection sensor 26, and a paper feeding sensor 27.

The lifter 20 is a part on which the recording material M is loaded and arranged, and is swingable about a fulcrum P.

The motor 21 is a driving source that pivotally moves the lifter 20 about the fulcrum P under the control of the control part 40.

The encoder 22 is driven by the rotation of the motor 21.

The rotation detection sensor 23 outputs, to the control part 40, a pulse signal that periodically fluctuates by the rotation of the encoder 22.

The recording material presence/absence detection sensor 24 detects presence/absence of a recording material arranged on the lifter 20 (presence/absence of the recording material M housed in the paper feed cassette 11).

The opening and closing detection sensor 25 detects the opened state and closed state of the paper feed cassette 11.

The upper limit detection sensor 26 detects that the upper surface of the recording material M arranged on the lifter 20 (in a case where no recording material is arranged on the lifter 20, the upper surface of the lifter 20) has reached a predetermined position. The predetermined position is, for example, a position that comes in contact with the paper feed roller 12.

The paper feeding sensor 27 detects paper feeding of a recording material from the paper feed cassette 11 to the transport path TR.

The camera 28 takes an image of the recording materials M housed in the paper feed cassette 11.

Figure 2:
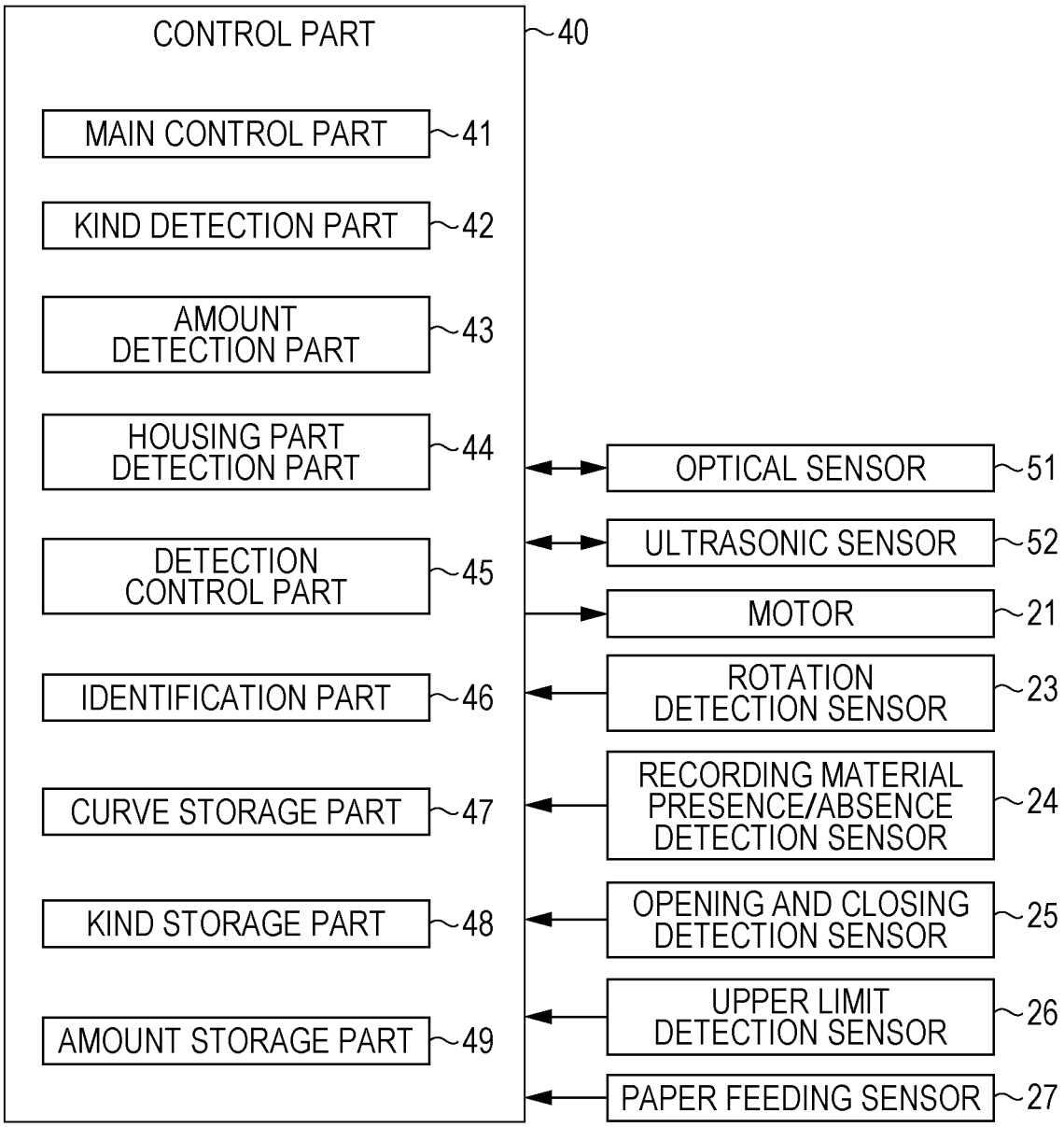
FIG. 2 is a diagram illustrating a functional configuration of a control part according to the first embodiment of the present invention.

FIG. 2 is a diagram illustrating a functional configuration of the control part 40 according to the first embodiment of the present invention.

With reference to FIG. 2, the control part 40 includes a main control part 41, a kind detection part 42 (an example of a kind detector), an amount detection part 43 (an example of an amount detector), a housing part detection part 44 (an example of a housing part detector), a detection control part 45 (an example of a controller), an identification part 46 (an example of an identification part), a curve storage part 47, a kind storage part 48 (an example of a storing part), and an amount storage part 49.

The main control part 41 controls the image forming apparatus 1 as a whole.

The kind detection part 42 uses the optical sensor 51 and the ultrasonic sensor 52 to detect a kind of the recording material transported by the recording material transport part 19.

The amount detection part 43 detects a height of the lifter 20 on the basis of the output of the rotation detection sensor 23, thereby detecting the amount of recording materials housed in the paper feed cassette 11.

The housing part detection part 44 detects replacement, addition and partial extraction of recording materials housed in the paper feed cassette 11 on the basis of a result of detection by the amount detection part 43. It should be noted that the housing part detection part 44 has only to detect replacement or addition of recording materials.

The detection control part 45 switches, on the basis of a result of detection by the housing part detection part 44, whether or not to execute detection of the recording materials housed in the paper feed cassette 11 by the kind detection part 42.

The identification part 46 identifies a kind of the recording materials housed in the paper feed cassette 11 on the basis of the result of the detection by the kind detection part 42 and the result of the detection by the amount detection part 43. The toner image formation part 30 and the fixing device 31 (an example of a printing part) perform printing on the recording material transported by the recording material transport part 19 under the conditions corresponding to the kind identified by the identification part 46.

Figure 5:
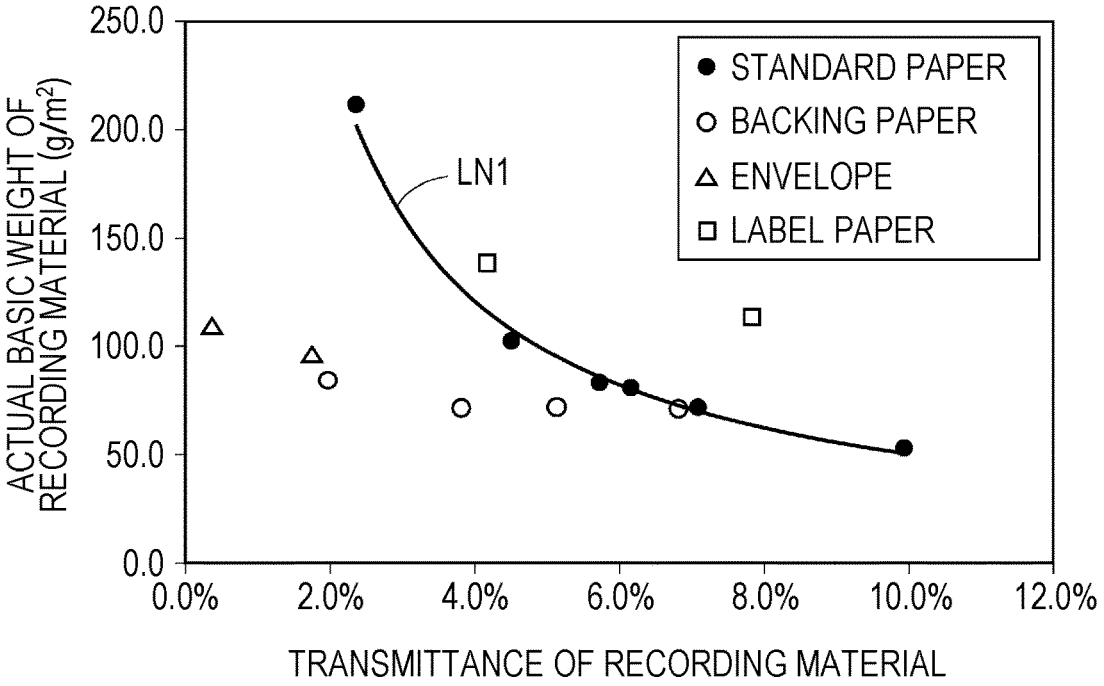
FIG. 5 is a graph illustrating a relationship between transmittance of light passing through a recording material, the light having been detected using the optical sensor, and an actual basic weight of the recording material, according to the first embodiment of the present invention.
Figure 6:
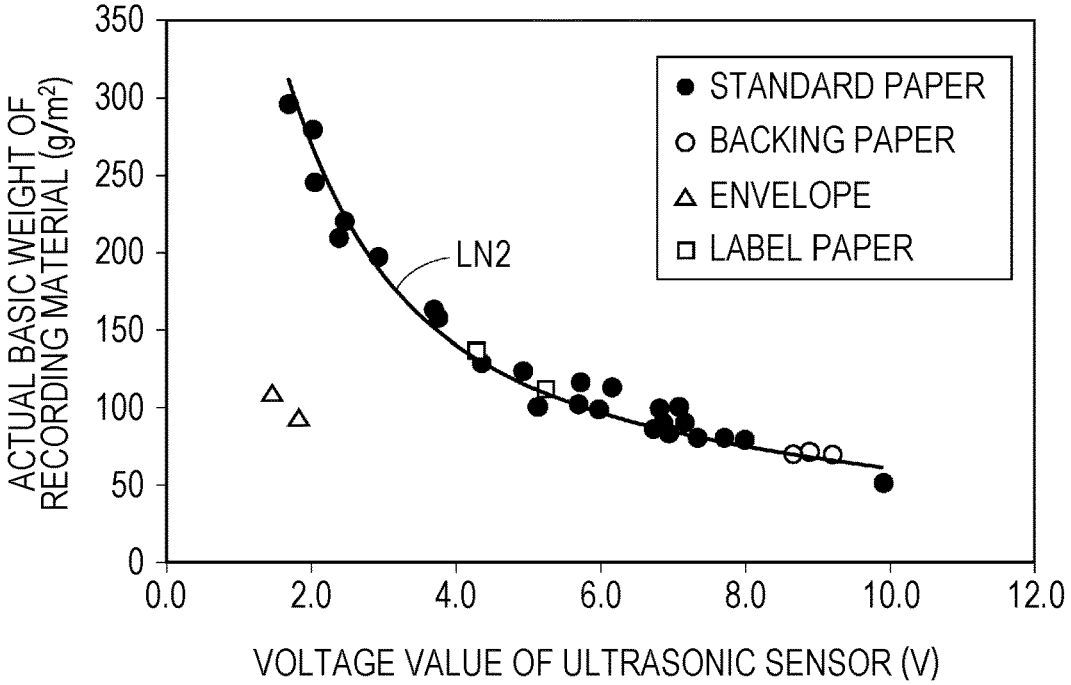
FIG. 6 is a drawing illustrating a relationship between a value of voltage output by the ultrasonic sensor and an actual basic weight of a recording material according to the first embodiment of the present invention.

The curve storage part 47 stores information required to detect a kind of the recording materials (more specifically, a curve LN1 in FIG. 5 and a curve LN2 in FIG. 6).

The kind storage part 48 stores information related to the kind of the recording materials M housed in the paper feed cassette 11 (paper kind information) (hereinafter it may be referred to as kind information) in a kind table.

The amount storage part 49 stores information related to the amount of the recording materials M associated with the kind information (paper-sheet amount detection data) (hereinafter it may be referred to as amount information) in the kind table.

Method for Detecting the Amount of Recording Materials Housed in Paper Feed Cassette Referring to FIG. 1, when the opening and closing detection sensor 25 detects that the paper feed cassette 11 has changed from an opened state to a closed state, the control part 40 drives the motor 21 to move (lift) up a right end part of the lifter 20 in FIG. 1. This causes the recording materials M on the lifter 20 to be lifted up. When the upper limit detection sensor 26 detects the recording materials M, the control part 40 stops the driving of the motor 21, and completes the movement of the lifter 20. Consequently, the recording material M that exists at the top among the recording materials M arranged on the lifter 20 comes in contact with the paper feed roller 12, and is brought into a state that enables transportation to the transport path TR. The control part 40 counts pulses that have been output from the rotation detection sensor 23 until the driving of the motor 21 is stopped, so as to detect the rotational amount of the motor 21, thereby detecting a moving distance of the lifter 20.

The moving distance of the lifter 20 corresponds to a height L of the right end part of the lifter 20 in FIG. 1 with reference to a position SP at which a moving distance of the lifter 20 is 0. Hereinafter, for the sake of convenience of explanation, the moving distance of the lifter 20 is referred to as the height of the lifter 20.

The height of the lifter 20 depends on the amount (thickness) of the recording materials M, and therefore the control part 40 is capable of detecting the amount of the recording materials M housed in the paper feed cassette 11 on the basis of the height of the lifter 20.

It should be noted that presence/absence of a recording material arranged on the lifter 20 (presence/absence of the recording material M housed in the paper feed cassette 11) may be detected by the output from the rotation detection sensor 23 as described above as an alternative to the recording material presence/absence detection sensor 24.

Any method for detecting the amount of recording materials M housed in the paper feed cassette 11 may be used; and methods other than the method based on the moving distance of the lifter described above may be used. For example, a load torque of the motor 21 for driving the lifter 20 changes according to the amount of the recording materials M housed in the paper feed cassette 11, and thus a current value of the motor 21 changes. Therefore, the amount of the recording materials M may be detected on the basis of the current value of the motor 21. In addition, the time until lifting up of the lifter 20 is completed changes according to the amount of the recording materials M housed in the paper feed cassette 11, and therefore the amount of the recording materials M may be detected on the basis of the time required to lift up the lifter 20. Moreover, the amount of the recording materials M housed in the paper feed cassette 11 may be calculated by taking an image inside the paper feed cassette 11 by the camera 28, and then by image processing the taken image. Further, the amount of the recording materials M may be detected by combining the above-described detection methods as appropriate.

(Method for Detecting a Kind of Transported Recording Material)

Figure 3:
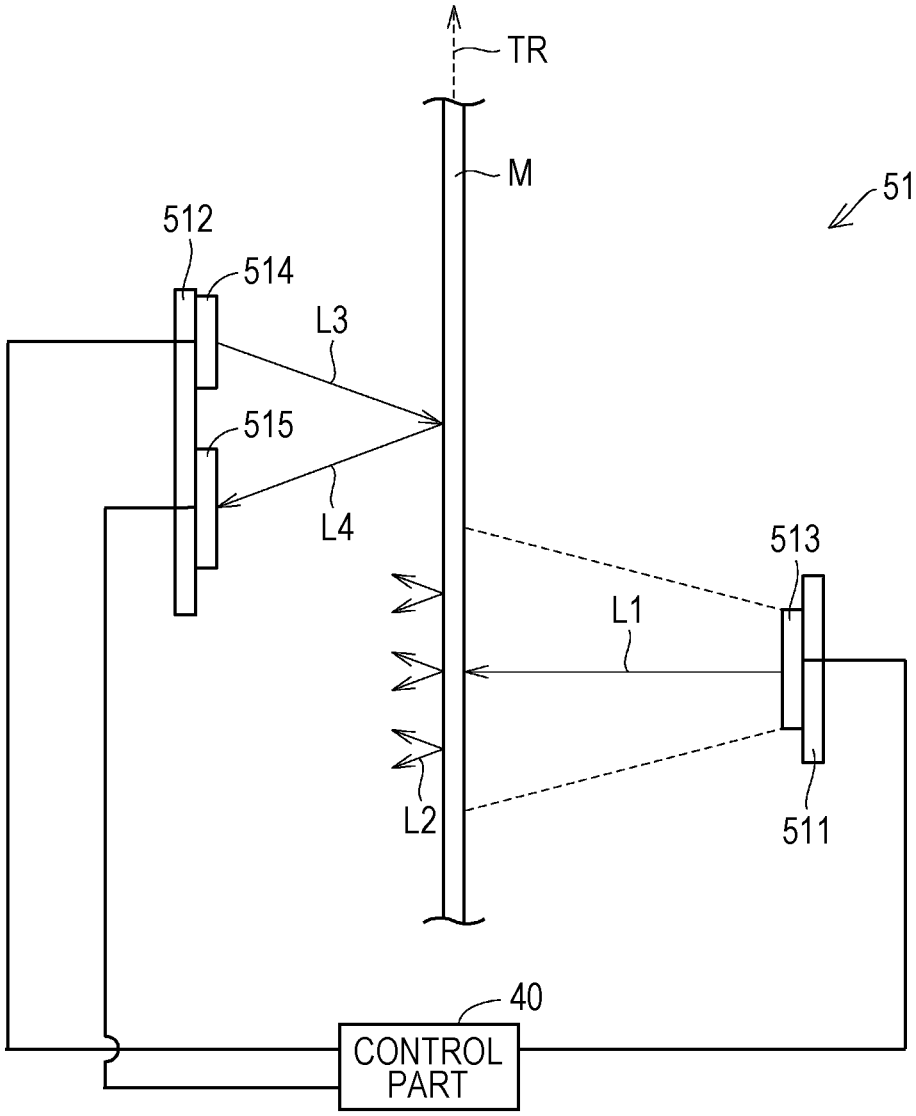
FIG. 3 is a diagram illustrating a configuration of an optical sensor according to the first embodiment of the present invention.

FIG. 3 is a diagram illustrating a configuration of the optical sensor 51 according to the first embodiment of the present invention.

Referring to FIG. 3, the optical sensor 51 outputs a voltage value corresponding to the quantity of transmitted light at a position along the transportation direction of the recording material M, the transmitted light passing through the recording material M. In addition, the optical sensor 51 outputs a voltage value corresponding to the quantity of reflected light passing through the recording material M. The optical sensor 51 includes substrates 511, 512, light-emitting elements 513, 514, and a light-receiving element 515.

The recording material M fed from the paper feed roller 12 is transported through a clearance formed by two rollers and guides, which are not illustrated, so as to suppress dispersion of transport positions. The light-emitting element 513 is arranged between the two rollers. The substrate 511 is arranged on the right side of the transport path TR in FIG. 3. The light-emitting element 513 is fixed to a surface that faces the transport path TR side in the substrate 511. The substrate 512 is arranged on the left side of the transport path TR in FIG. 3. The light-emitting element 514 and the light-receiving element 515 are fixed to a surface that faces the transport path TR side in the substrate 512.

The light-emitting element 514 sequentially irradiates the recording material M with light L3 that is light having each color of R (red), G (green) and B (blue), and becomes reflected light, under the control of the control part 40. The light-receiving element 515 receives reflected light L4 reflected by the recording material M, and outputs, to the control part 40, a voltage value corresponding to the quantity of reflected light that has been received. The control part 40 detects color appearance of the recording material M on the basis of the voltage value corresponding to the quantity of reflected light output from the light-receiving element 515.

The light-emitting element 513 emits light L1 that has properties based on the color appearance of the recording material M, and becomes transmitted light passing through the recording material M, under the control of the control part 40. The light-emitting element 513 emits the light L1 in the timing that differs from the light-emitting timing of the light-emitting element 514. The light-receiving element 515 receives transmitted light L2 passing through the recording material M (mainly scattered light scattered by the recording material M), and outputs, to the control part 40, a voltage value corresponding to the quantity of transmitted light at a position along the transport direction of the recording material M, the quantity of transmitted light being the quantity of the transmitted light L2.

The control part 40 detects transmittance of the recording material M on the basis of the voltage value received from the light-receiving element 515.

Figure 4:
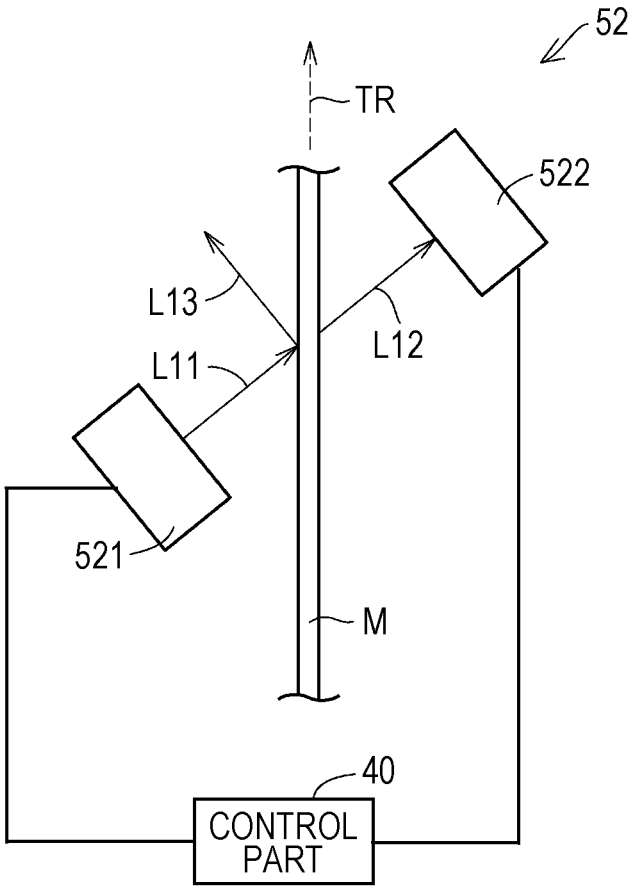
FIG. 4 is a diagram illustrating a configuration of an ultrasonic sensor according to the first embodiment of the present invention.

FIG. 4 is a diagram illustrating a configuration of the ultrasonic sensor 52 according to the first embodiment of the present invention.

Referring to FIG. 4, the ultrasonic sensor 52 outputs a voltage value corresponding to the amount of ultrasonic waves passing through the recording material M. The ultrasonic sensor 52 includes a transmission part 521, and a receiving part 522. The transmission part 521 is arranged on the left side of the transport path TR in FIG. 4. The receiving part 522 is arranged on the right side of the transport path TR in FIG. 4, and is arranged diagonally above the transmission part 521.

The transmission part 521 irradiates the recording material M with the ultrasonic wave L11 at a predetermined angle under the control of the control part 40. It should be noted that the light L1 has only to be an electromagnetic wave having a wavelength different from that of the ultrasonic wave L11.

The ultrasonic wave L11 is divided into an ultrasonic wave L12 passing through the recording material M and an ultrasonic wave L13 reflected by the recording material M. The receiving part 522 receives the ultrasonic wave L12 passing through the recording material M, and outputs, to the control part 40, a voltage value corresponding to the amount of the received ultrasonic wave.

The control part 40 detects a basic weight of the recording material M on the basis of the voltage value received from the receiving part 522. The control part 40 detects the basic weight of the recording material M on the basis of a ratio (damping factor) of a peak value of the amount of ultrasonic waves, which is indicated by the voltage value output from the receiving part 522, to a peak value of the amount of ultrasonic waves transmitted from the transmission part 521.

Incidentally, in a case where the image forming apparatus 1 includes a plurality of paper feed cassettes 11, it is preferable that the optical sensor 51 and the ultrasonic sensor 52 be arranged on the more downstream side than a junction of transport paths of recording materials fed from the plurality of paper feed cassettes 11. Consequently, the number of optical sensors 51 and the number of ultrasonic sensors 52 can be reduced in comparison with a case where the optical sensor 51 and the ultrasonic sensor 52 are arranged in each of the plurality of paper feed cassettes 11. As the result, manufacturing costs can be reduced.

FIG. 5 is a graph illustrating a relationship between transmittance of light passing through a recording material, the light having been detected using the optical sensor 51, and an actual basic weight of the recording material, according to the first embodiment of the present invention.

Referring to FIG. 5, the control part 40 stores the curve LN1. The curve LN1 is a reference curve on a biaxial coordinate, and shows a change in reference value of the basic weight according to transmittance of light (transmitted light L2) passing through the recording material (hereinafter it may be referred to as transmittance of the recording material), the light having been detected using the optical sensor 51. The curve LN1 is calculated from the relationship obtained in a case where the recording material is standard paper. The control part 40 detects the transmittance of the recording material on the basis of the quantity of transmitted light passing through the recording material.

In a case where the recording material is standard paper, a point showing the relationship between the transmittance of the detected recording material and the actual basic weight of the recording material substantially exists on the curve LN1. Meanwhile, in a case where the recording material is backing paper, envelope or label paper, a point showing the relationship between the transmittance of the detected recording material and the actual basic weight of the recording material deviates from the curve LN1. Incidentally, the label paper is a recording material that includes a material having an adhesive adhered to the back side thereof, and a base paper on which the material is stuck. By removing the material from the base paper, the material can be stuck on a target object.

More specifically, in a case where the recording material is backing paper or envelope, the basic weight obtained from the curve LN1 on the basis of the transmittance of the detected recording material becomes higher than the actual basic weight. This is because backing paper contains printed parts, with the result that light hardly passes through the backing paper in comparison with standard paper. The envelope is formed by layered sheets of paper, and therefore light hardly passes through the envelope in comparison with standard paper. In a case where the recording material is label paper, the basic weight obtained from the curve LN1 on the basis of the transmittance of the detected recording material becomes lower than the actual basic weight. This is because the label paper has a higher specific gravity than that of standard paper.

It should be noted that although not shown in the graph in FIG. 5, overhead projector (OHP) sheets have extremely high light transmittance (higher than a predetermined transmittance threshold value) in comparison with standard paper, label paper, backing paper, envelope and the like. Therefore, if the recording material is an OHP sheet, the recording material can be detected by using the optical sensor 51.

FIG. 6 is a drawing illustrating a relationship between a value of voltage output by the ultrasonic sensor 52 and an actual basic weight of a recording material according to the first embodiment of the present invention.

Referring to FIG. 6, the control part 40 stores the curve LN2. The curve LN2 is a reference curve showing the relationship between a value of voltage output by the ultrasonic sensor 52 and an actual basic weight of the recording material. The curve LN2 is a reference curve that is calculated from the relationship obtained in a case where the recording material is standard paper. The control part 40 detects a basic weight of the recording material by using the curve LN2 on the basis of a voltage value output by the ultrasonic sensor 52.

In a case where the recording material is standard paper, label paper or backing paper, a point showing the relationship between the voltage value and the actual basic weight of the recording material substantially exists on the curve LN2. In particular, in a case where the recording material is backing paper, printed parts rarely influence an ultrasonic wave. Meanwhile, in a case where the recording material is envelope, a point showing the relationship between the voltage value and the actual basic weight of the recording material deviates from the curve LN2. In a case where the recording material is envelope, the basic weight of the recording material detected by using the curve LN2 on the basis of the voltage value becomes higher than the actual basic weight. This is because the envelope is formed by layered sheets of paper, with the result that the ultrasonic wave hardly passes through the envelope in comparison with standard paper.

From the relationships shown in FIGS. 5 and 6, the control part 40 is capable of detecting a kind of the recording material M from among standard paper, label paper, backing paper, envelope, OHP sheet and the like on the basis of the outputs from the optical sensor 51 and the ultrasonic sensor 52. Kinds of the recording material M which can be detected by the control part 40 may be arbitrary determined.

It should be noted that the most suitable transport speed differs depending on a kind of the recording material M to be transported. For example, in a case where a sheet of heavy paper is transported at a transport speed for standard paper, the transport speed is too fast. Therefore, there is a possibility that a malfunction such as an image failure, a fixing failure or a paper jam will occur. Therefore, in a case where a kind of the recording material M is detected, in order to prevent a malfunction from occurring, it is necessary to transport the recording material M at slow transport speed (for example, a transport speed applied in a case where the recording material M is heavy paper). As the result, in a case where all of the recording materials to be transported are subjected to kind detection, the kind detection exerts a harmful influence on first printing and throughput, which causes the productivity to decrease.

Accordingly, in the embodiments described below, replacement or addition of the recording materials M housed in the paper feed cassette 11 is detected, and whether or not to execute kind detection of the recording materials M housed in the paper feed cassette 11 is switched on the basis of a result of the detection. Consequently, the decrease in productivity is suppressed.

(Operation of Detecting a Kind of Recording Material)

Figure 7:
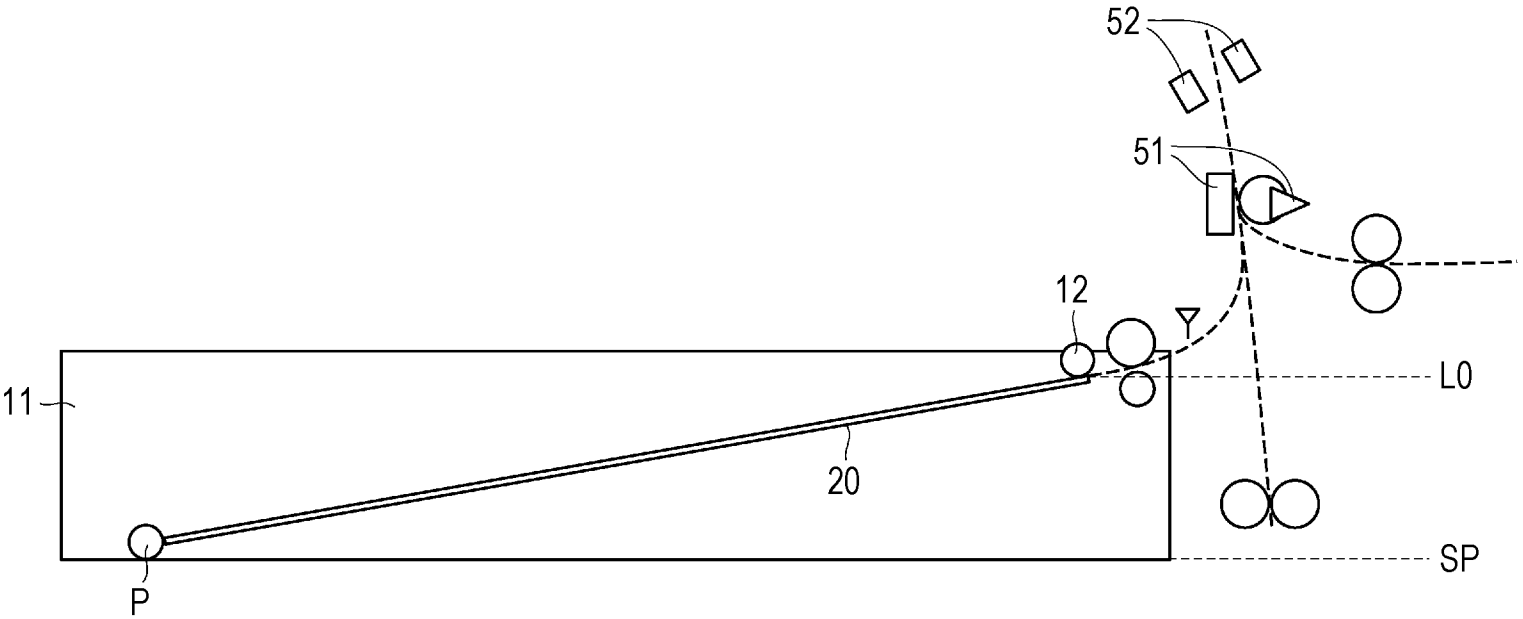
FIG. 7 is a cross-sectional view illustrating a state in which a paper feed cassette has no recording material housed therein in the first embodiment of the present invention.

FIG. 7 is a cross-sectional view illustrating a state in which the paper feed cassette 11 has no recording material M housed therein in the first embodiment of the present invention. It should be noted that FIG. 7, FIG. 9, FIG. 11, FIGS. 13 to 15, FIG. 17, FIG. 19 and FIG. 21 described below each show only a partial configuration in the image forming apparatus 1.

Referring to FIG. 7, in a state in which the paper feed cassette 11 has no recording material M stored therein, the lifter 20 is lifted up to the maximum. Therefore, the height of the lifter 20 detected by the control part 40 becomes a height L0 that is the maximum value, and the recording material presence/absence detection sensor 24 detects absence of a recording material.

In a case where replacement, addition, partial extraction or the like of the recording materials of the paper feed cassette 11 is performed, user's operation causes the paper feed cassette 11 to carry out opening and closing operation in which the paper feed cassette 11 changes from a closed state to an opened state, and changes from the opened state to the closed state again. On the basis of a result of detecting the amount of recording materials before and after this opening and closing operation, the control part 40 detects replacement, addition and partial extraction of the recording materials of the paper feed cassette 11.

FIG. 8 is a drawing illustrating contents of the kind table obtained in a case where the recording material presence/absence detection sensor 24 has detected absence of a recording material in the first embodiment of the present invention.

Referring to FIG. 8, the control part 40 stores the kind table in the HDD. The kind table includes: an order field indicating the order of the recording material on the lifter 20; a kind information (information related to the kind of the recording materials M) field; and an amount information (information related to the amount of the recording materials M associated with the kind information) field. The kind information field is a storage area that is rewritten by the kind storage part 48 (FIG. 2) of the control part 40; and the amount information field is a storage area that is rewritten by the amount storage part 49 (FIG. 2) of the control part 40.

For example, in a case where the recording materials M housed in the paper feed cassette 11 have run out as the result of paper feeding, or in a case where all of the recording materials M housed in the paper feed cassette 11 are extracted by a user, and subsequently the paper feed cassette 11 is closed, the paper feed cassette 11 is in a closed state, and in a state in which the paper feed cassette 11 has no recording material M stored therein. In a case where the paper feed cassette 11 is in a closed state, and the recording material presence/absence detection sensor 24 detects absence of recording material, the control part 40 clears all of the contents of the kind information field and the contents of the amount information field as shown in FIG. 8.

Figure 9:
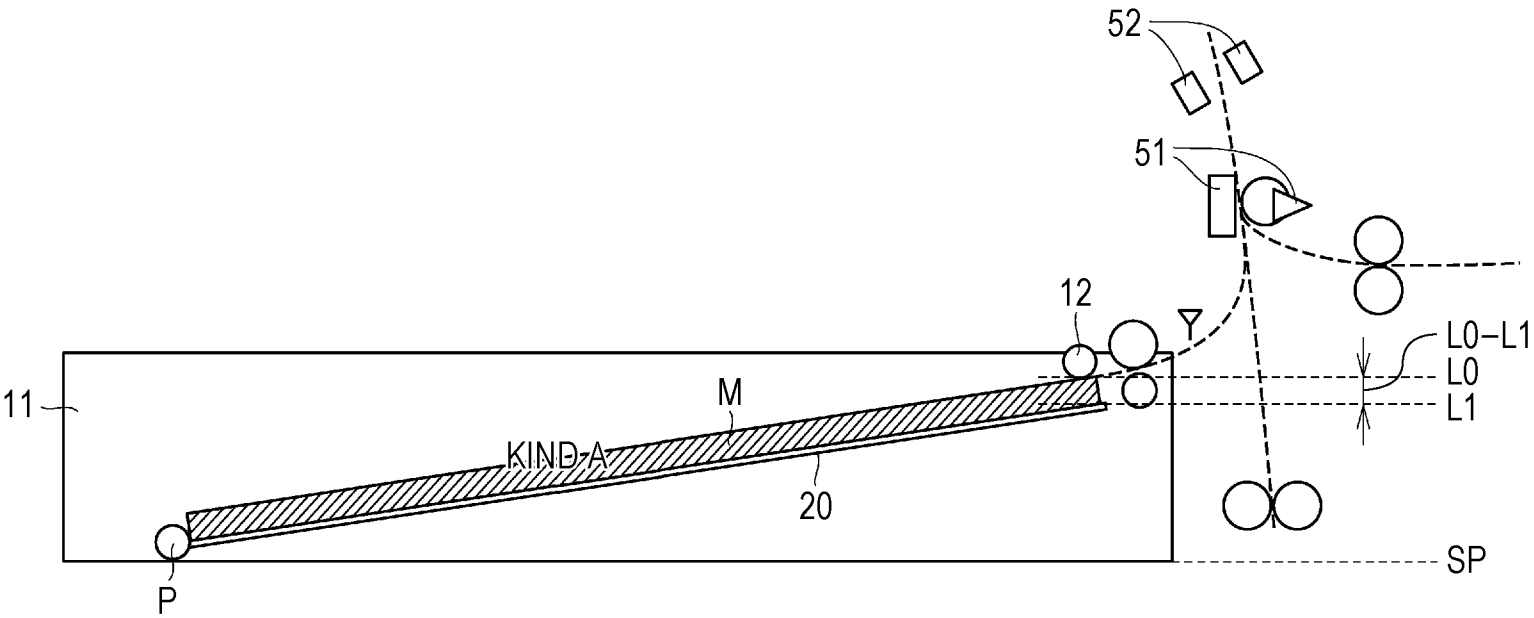
FIG. 9 is a cross-sectional view schematically illustrating a state (first state) of the paper feed cassette immediately after replacement of recording materials has been completed in the first embodiment of the present invention.

FIG. 9 is a cross-sectional view schematically illustrating a state (first state) of the paper feed cassette 11 immediately after replacement of recording materials has been completed in the first embodiment of the present invention.

Referring to FIG. 9, here, action of replenishing the paper feed cassette 11 with recording materials in a state in which recording materials housed in the paper feed cassette 11 have run out, or action of extracting all of the recording materials housed in the paper feed cassette 11, and then replenishing the paper feed cassette 11 with new recording materials, is defined as replacement of recording materials.

In a case where replacement of recording materials is performed, the recording material presence/absence detection sensor 24 detects absence of recording material from the time at which the paper feed cassette 11 is in an opened state, and in a state in which no recording material M is housed in the paper feed cassette 11 until a user replenishes the paper feed cassette 11 with the recording materials M. Alternatively, the recording material presence/absence detection sensor 24 detects absence of recording material from the time at which the paper feed cassette 11 is in an opened state, and in a state in which all of the recording materials M housed in the paper feed cassette 11 are extracted until the user replenishes the paper feed cassette 11 with new recording materials M.

Therefore, the control part 40 detects absence of recording material by the recording material presence/absence detection sensor 24 in a state in which the opening and closing detection sensor 25 is detecting an opened state during the opening and closing operation of the paper feed cassette 11. In a case where presence of recording material is detected by the recording material presence/absence detection sensor 24 after the opening and closing operation of the paper feed cassette 11 is completed, the control part 40 detects replacement of recording materials.

When the replacement of the recording materials is completed, the lifter 20 stops at a position that is lowered by the thickness of the replenished recording materials. On the basis of the output of the rotation detection sensor 23, the control part 40 detects that the height of the lifter 20 has become the height L1 (<L0). The thickness of the replenished recording materials corresponds to the thickness (L0–L1).

In a case where replacement of recording materials has been performed, a kind of the recording materials M housed in the paper feed cassette 11 is unknown. Therefore, in a case where the replacement of recording materials has been detected, the control part 40 detects a kind of a first number of sheets of recording materials transported earlier after the paper feed cassette 11 has become the closed state (here, a first sheet of recording material in a print job executed by the image forming apparatus 1 first). Subsequently, the control part 40 determines that the kind of all of the recording materials M housed in the paper feed cassette 11 after the replacement is the kind that has been detected.

In a case where a kind of recording material is detected, when the recording material M is fed by the paper feed roller 12, and is transported to the resist roller 14 (or after the recording material M reaches the resist roller 14), the control part 40 detects a kind of recording material by using the optical sensor 51 and the ultrasonic sensor 52 On the assumptions that the transport speed for standard paper is V2, and the transport speed for heavy paper is V1, it is preferable that the transport speed V0 of the recording material applied when a kind of recording material is detected be set at a value that satisfies the following inequality (1). This is because a kind of the recording material is unknown, and in a case where a sheet of heavy paper is transported at the transport speed for standard paper, there is a possibility that a malfunction such as a paper jam will occur.

$$V2>V1\geq V0 \quad (1)$$

Here, it is assumed that the control part 40 has detected that the kind of the recording material is "kind A". In this case, the control part 40 determines that the kind of all of the recording materials M housed in the paper feed cassette 11 after the replacement is the "kind A" that has been detected.

FIG. 10 is a drawing illustrating a state (first state) after update of the kind table obtained in a case where all of the recording materials M replenished in the paper feed cassette 11 have been identified as the "kind A" in FIG. 9.

When all of the recording materials M replenished in the paper feed cassette 11 have been identified as "kind A", the control part 40 updates the kind table. The control part 40 stores "kind A" in the kind information field, and stores "height L0 to height L1" in the amount information field in a record, the order of recording material of which is the first, in the kind table. The kind information and the amount information mean that recording materials of "kind A" are housed within a height range of the lifter 20 from "height L0 to height L1" (in other words, recording materials of "kind A" are housed on the bottom part of the lifter 20, the recording materials having a thickness obtained by the subtraction of "height L0–height L1").

After the control part 40 identifies kinds of all of the recording materials M replenished in the paper feed cassette 11, the control part 40 does not detect a kind of recording material until replacement or addition of recording materials is newly detected (or until absence of recording material is detected by the recording material presence/absence detection sensor 24). In a case where a print job is executed, the control part 40 determines a kind of the recording materials M housed in the paper feed cassette 11 to be "kind A" according to the kind table, transports the recording material M under transportation conditions suitable for the "kind A", and performs printing under conditions suitable for the "kind A".

It should be noted that in a case where the amount of recording materials M housed in the paper feed cassette 11 has decreased as the result of the execution of the print job, the control part 40 may reflect the decrease on the kind table. In other words, every time paper feeding is performed, the control part 40 may repeatedly detect the height of the lifter 20 on the basis of the output of the rotation detection sensor 23 to update the kind table on the basis of the result of the detection (more specifically, the "height L1" in the amount information field of the kind table in FIG. 10 is updated to newly detected height).

In the explanation below, the state shown in FIGS. 9 and 10 (a state in which replacement with recording materials of the "kind A" has been completed, and consequently the kind table has been updated) may be referred to as the first state.

Second Embodiment

In each of the second to fourth embodiments described blow, operation of the image forming apparatus 1 under a situation different from that of the first embodiment will be described. A configuration of the image forming apparatus according to each of the second to fourth embodiments, and operation other than the part explained in each of the second to fourth embodiments, are similar to the configuration and operation of the image forming apparatus according to the first embodiment, and therefore explanation thereof will not be repeated.

In the present embodiment, operation of the image forming apparatus 1 carried out in a case where addition of recording materials has been performed from the first state will be described.

Figure 11:
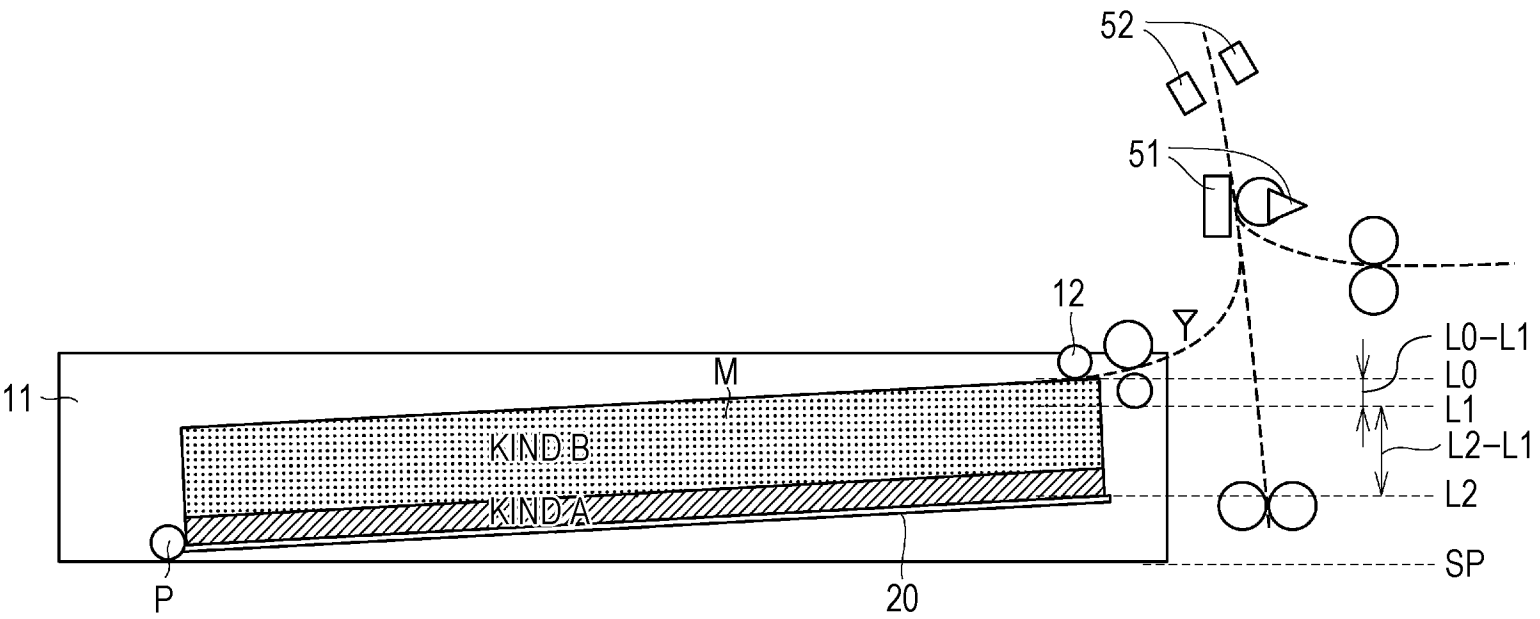
FIG. 11 is a cross-sectional view schematically illustrating a state (second state) of the paper feed cassette immediately after addition of recording materials of "kind B" has been completed from the first state in a second embodiment of the present invention.

FIG. 11 is a cross-sectional view schematically illustrating a state (second state) of the paper feed cassette 11 immediately after addition of recording materials of "kind B" has been completed from the first state in the second embodiment of the present invention.

Referring to FIG. 11, here, action of replenishing the paper feed cassette 11 with new recording materials without extracting recording materials housed in the paper feed cassette 11 is defined as addition of recording materials In a case where addition of recording materials is performed, recording materials are already housed in the paper feed cassette 11. Therefore, recording material are always housed in the paper feed cassette 11 during opening and closing operation. Accordingly, the control part 40 does not detect absence of recording material by the presence/absence detection sensor 24 during the opening and closing operation of the paper feed cassette 11, but in a case where an increase in amount of recording materials before and after the opening and closing operation (here, a decrease in height of the lifter 20 detected on the basis of the output of the rotation detection sensor 23) is detected, the control part 40 detects addition of recording materials.

When the addition of recording materials is completed, the lifter 20 stops at a position that is lowered by the thickness of the added recording materials. On the basis of the output of the rotation detection sensor 23, the control part 40 detects that the height of the lifter 20 has become the height L2 (<L1). The thickness of the added recording materials corresponds to the thickness (L1−L2).

In a case where addition of recording materials has been detected, the control part 40 calculates a boundary part of the added recording materials on the basis of the result of detecting the amount of recording materials before the opening and closing operation of the paper feed cassette 11, and then stores the calculated boundary part in the kind table. Here, on the basis of the height L1 of the lifter 20 before the opening and closing operation of the paper feed cassette 11, a position of the recording material M obtained in a case where the height of the lifter 20 has become the height L1 is calculated as the boundary part.

In a case where addition of recording materials has been performed, the kind of recording materials M housed in the paper feed cassette 11 before the addition (recording materials M housed on the lower side than the boundary part (on the bottom side of the lifter 20)) is determined to be the "kind A". However, a kind of the added recording materials M (recording materials M housed on the upper side than the boundary part) is unknown. Therefore, in a case where the addition of recording materials has been detected, the control part 40 detects a kind of recording materials for a second number of sheets of recording materials transported earlier after the paper feed cassette 11 has become the closed state (here, a first sheet of recording material in a print job executed by the image forming apparatus 1 first). Subsequently, the control part 40 determines that among the recording materials M housed in the paper feed cassette 11 after the addition, the kind of the added recording materials M is the kind that has been detected.

Here, the control part 40 detects that the kind of the recording material is "kind B". In this case, the control part 40 identifies the kind of the added recording materials M as the "kind B" that has been detected.

FIG. 12 is a drawing illustrating a state (second state) after update of the kind table obtained in a case where the recording materials M added in the paper feed cassette 11 have been identified as "kind B" in FIG. 11.

When the recording materials M added in the paper feed cassette 11 have been identified as "kind B", the control part 40 updates the kind table. The control part 40 stores "kind B" in the kind information field, and stores "height L1 to height L2" in the amount information field in a record, the order of recording material of which is the second, in the kind table shown in FIG. 10. The kind information and the amount information, which have been newly stored, mean that recording materials of "kind B" are housed within a height range of the lifter 20 from "height L1 to height L2" (in other words, recording materials of "kind B" are housed in a second part from the bottom of the lifter 20, the recording materials having a thickness obtained by the subtraction of "height L1−height L2").

In the explanation below, the state shown in FIGS. 11 and 12 (a state in which the addition of recording materials of "kind B" has been completed, and consequently the kind table has been updated) may be referred to as a second state.

Figure 13:
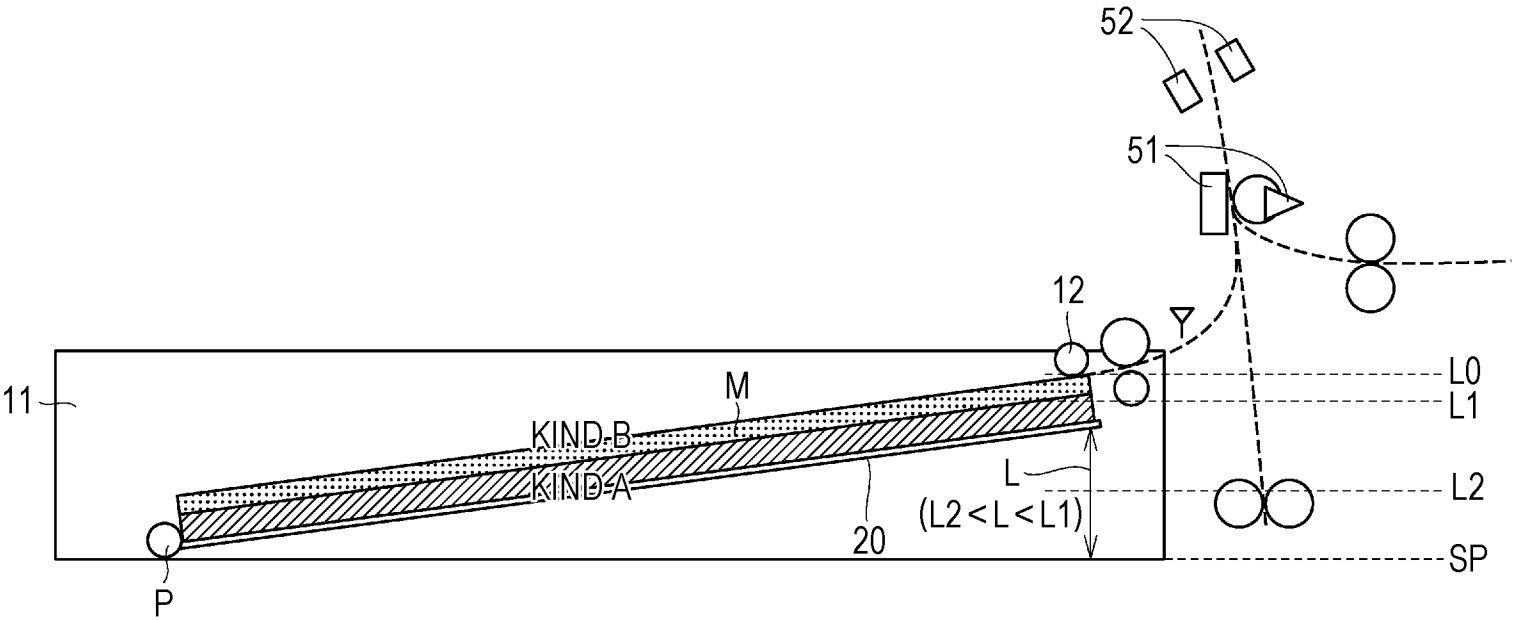
FIG. 13 is a cross-sectional view schematically illustrating a state of the paper feed cassette obtained in a case where a height L of a lifter is lower than a height L1 ($L2<L<L1$) in the second embodiment of the present invention.
Figure 14:
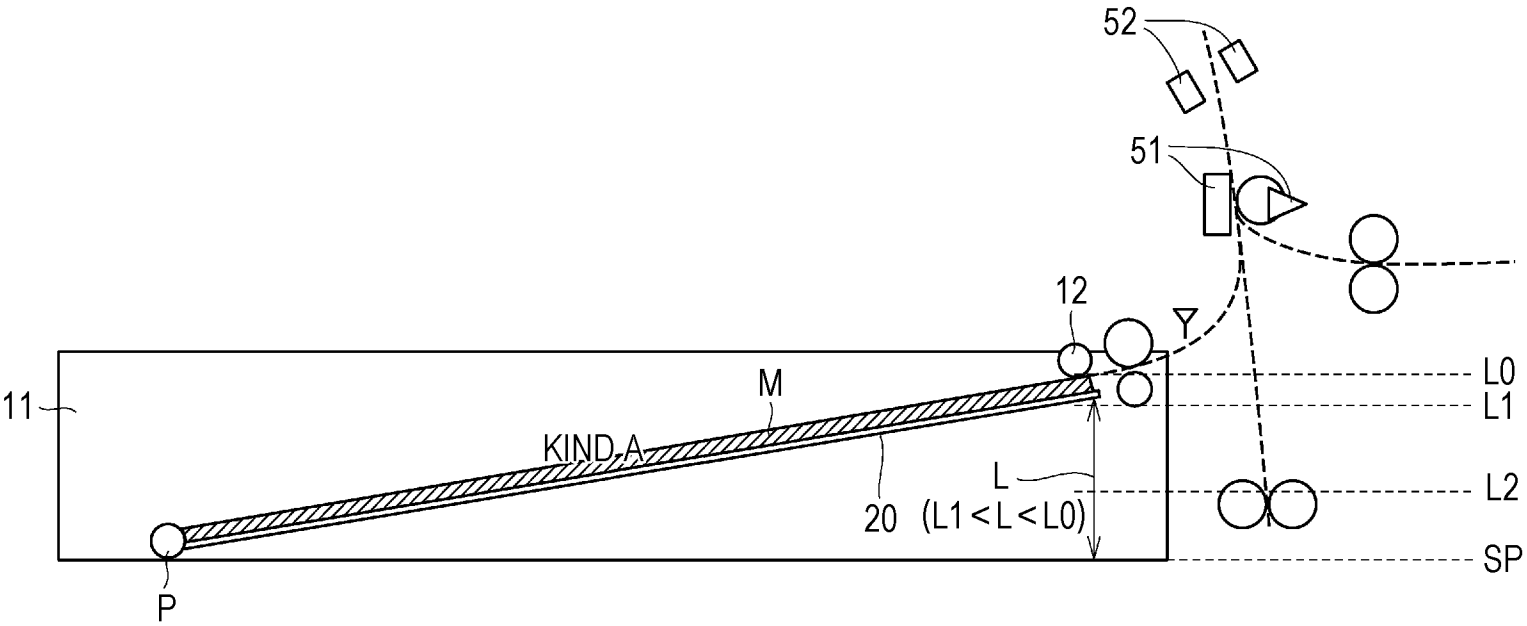
FIG. 14 is a cross-sectional view schematically illustrating a state of the paper feed cassette obtained in a case where the height L of the lifter is higher than the height L1 ($L1<L<L0$) in the second embodiment of the present invention.

FIG. 13 is a cross-sectional view schematically illustrating a state of the paper feed cassette 11 obtained in a case where the height L of the lifter 20 is lower than the height L1 (L2<L<L1) in the second embodiment of the present invention. FIG. 14 is a cross-sectional view schematically illustrating a state of the paper feed cassette 11 obtained in a case where the height L of the lifter 20 is higher than the height L1 (L1<L<L0) in the second embodiment of the present invention.

Referring to FIGS. 13 and 14, after the kind of the recording materials M added in the paper feed cassette 11 is identified, the control part 40 does not detect a kind of recording materials until replacement or addition of recording materials is newly detected (or until absence of recording material is detected by the recording material presence/absence detection sensor 24).

As shown in FIG. 13, until the height L of the lifter 20 reaches the height L1, the height L having been detected on the basis of the output of the rotation detection sensor 23 (in other words, until the recording materials M of "kind B" housed in the paper feed cassette 11 run out), when a print job is executed, the control part 40 detects that the kind of the recording materials M housed in the paper feed cassette 11 is "kind B" according to the kind table, transports the recording material M under transportation conditions suitable for the "kind B", and performs printing under conditions suitable for the "kind B".

In addition, as shown in FIG. 14, in a case where the amount of recording materials M housed in the paper feed cassette 11 has decreased as the result of the execution of the print job, and consequently the height L of the lifter 20 becomes higher than the height L1, the height L having been detected on the basis of the output of the rotation detection sensor 23, when a print job is executed, the control part 40 detects that the kind of the recording materials M housed in the paper feed cassette 11 is "kind A" according to the kind table, transports the recording material M under transportation conditions suitable for the "kind A", and performs printing under conditions suitable for the "kind A".

It should be noted that in a case where the kind of the recording materials M added in the paper feed cassette 11

(the recording materials M housed in the upper part than the boundary part) differs from that of the recording materials M housed in the paper feed cassette 11 before the addition (the recording materials M housed on the lower side than the boundary part), the control part 40 may warn a user that a different kind of recording materials have been added, for example, by displaying a message on the operation panel 34 (FIG. 1).

Moreover, the control part 40 may notify the user of at least one of pieces of information: the boundary part of the recording materials M; the kind of the recording materials M housed in the paper feed cassette 11; and the amount of the recording materials M housed in the paper feed cassette 11, the information being obtained in a case where the addition has been performed, by a method such as displaying the information on the operation panel 34.

Figure 15:
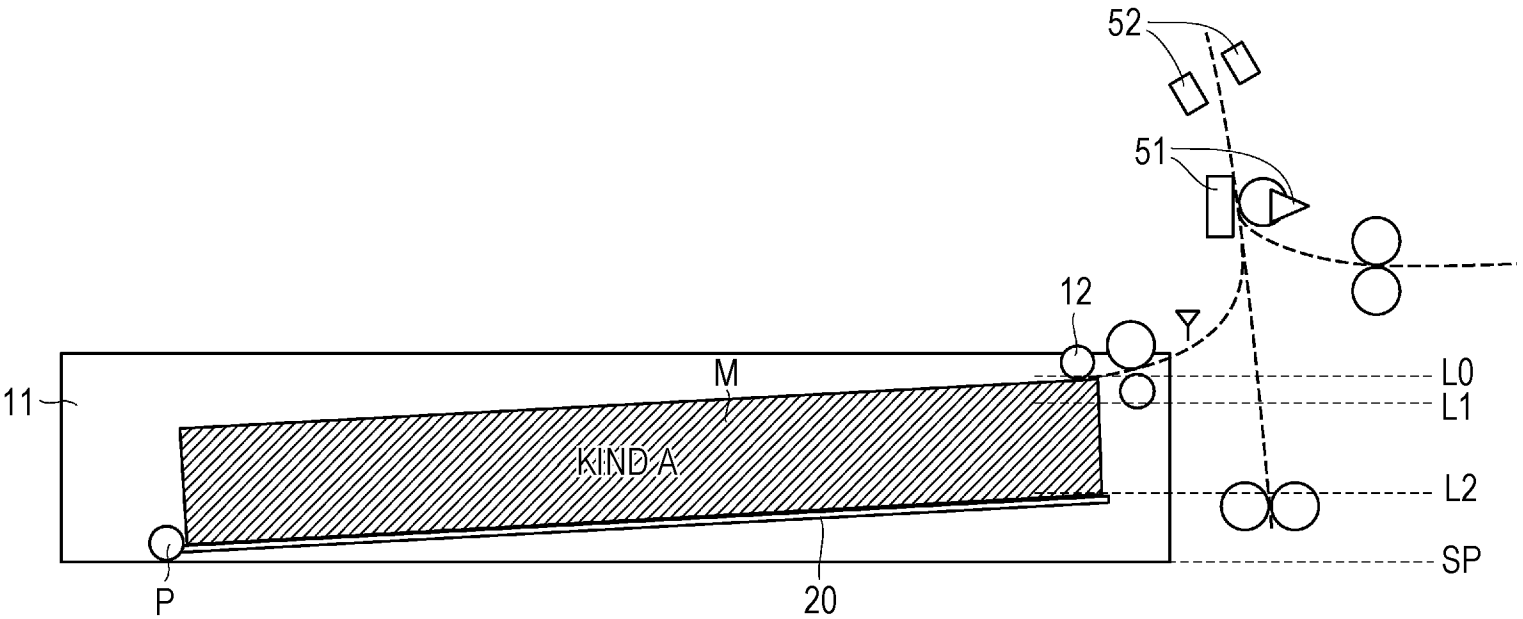
FIG. 15 is a cross-sectional view schematically illustrating a state of the paper feed cassette immediately after addition of recording materials of "kind A" has been completed from the first state in the second embodiment of the present invention.

FIG. 15 is a cross-sectional view schematically illustrating a state of the paper feed cassette 11 immediately after the addition of recording materials of "kind A" has been completed from the first state in the second embodiment of the present invention.

Referring to FIG. 15, in a case where recording materials of "kind A" have been added from the first state, the control part 40 identifies the kind of the recording materials added in the paper feed cassette 11 as "kind A". In other words, the control part 40 determines that the kind of the recording materials housed in the upper part than the identified boundary part is the same as the kind stored in the kind table before the addition of the recording materials is detected. In this case, the control part 40 identifies all of the recording materials M housed in the paper feed cassette 11 as "kind A".

FIG. 16 is a drawing illustrating a state after update of the kind table obtained in a case where the recording materials M added in the paper feed cassette 11 have been identified as "kind A" in FIG. 15.

When the kind of the recording materials added in the paper feed cassette 11 is identified as "kind A", the control part 40 updates the kind table in such a manner that the recording materials M housed in the upper part than the boundary part and the recording materials M housed in the lower part than the boundary part are stored as the same kind of recording materials. The control part 40 updates "height L0 to height L1" in the amount information field associated with "kind A" of the kind table in FIG. 10 to "height L0 to height L2". The kind information and the amount information after update, which relate to "kind A", mean that the recording materials of "kind A" are housed within a height range of the lifter 20 from "height L0 to height L2".

In a case where it is detected that the kind of the recording materials is "kind A", the control part 40 does not detect a kind of subsequent recording materials.

Referring to FIG. 9, incidentally, in the first state, the control part 40 does not detect absence of recording material by the presence/absence detection sensor 24 during the opening and closing operation of the paper feed cassette 11, and in a case where it is detected that the amount of recording materials is the same before and after the opening and closing operation (here, the height of the lifter 20 detected on the basis of the output of the rotation detection sensor 23 is the same before and after the opening and closing operation), the control part 40 does not detect replacement, addition and partial extraction of recording materials of the paper feed cassette 11. In this case, until replacement or addition of recording materials is newly detected (or until absence of recording material is detected by the recording material presence/absence detection sensor 24), the control part 40 does not detect a kind of recording materials, and does not update the kind table. According to the kind table shown in FIG. 10, the control part 40 determines a kind of the recording materials M housed in the paper feed cassette 11 to be "kind A", transports the recording material M under transportation conditions suitable for the "kind A", and performs printing under conditions suitable for the "kind A".

Third Embodiment

In the present embodiment, operation of the image forming apparatus 1 carried out in a case where partial extraction of recording materials has been performed from the second state will be described.

Figure 17:
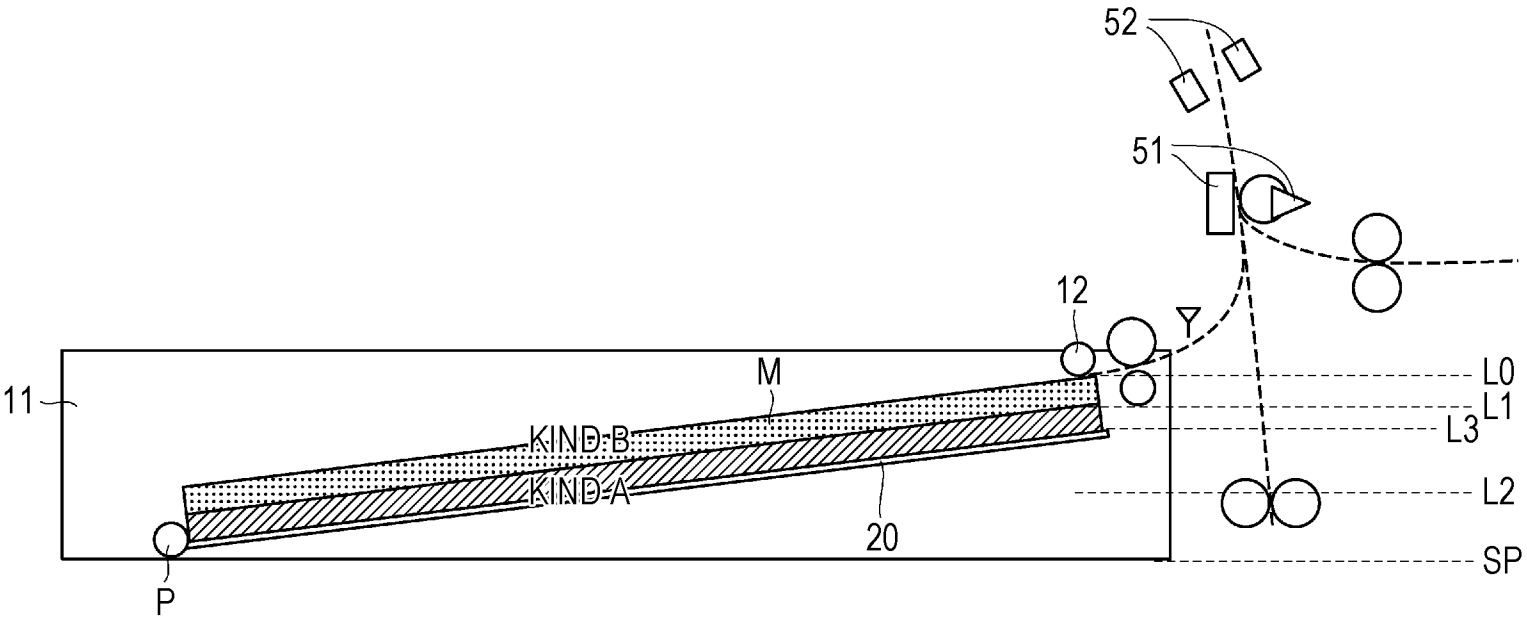
FIG. 17 is a cross-sectional view schematically illustrating an example of a state of the paper feed cassette immediately after partial extraction of recording materials has been completed from the second state in a third embodiment of the present invention.

FIG. 17 is a cross-sectional view schematically illustrating an example of a state of the paper feed cassette 11 immediately after partial extraction of recording materials has been completed from the second state in the third embodiment of the present invention.

Referring to FIG. 17, in a case where partial extraction of recording materials is performed, among the recording materials M housed in the paper feed cassette 11, a part that is not extracted remains in the paper feed cassette 11. Therefore, the control part 40 does not detect absence of recording material by the presence/absence detection sensor 24 during the opening and closing operation of the paper feed cassette 11, but in a case where a decrease in amount of recording materials before and after the opening and closing operation (here, an increase in height of the lifter 20 detected on the basis of the output of the rotation detection sensor 23) is detected, the control part 40 detects partial extraction of recording materials.

When the partial extraction of recording materials is completed, the lifter 20 stops at a position that is lifted by the thickness of the extracted recording materials. On the basis of the output of the rotation detection sensor 23, the control part 40 detects that the height of the lifter 20 has become the height L3.

In a case where partial extraction of recording materials has been detected, the control part 40 updates the kind table on the basis of the information of the boundary part stored in the kind table, and the result of detecting the amount of recording materials after the completion of the opening and closing operation of the paper feed cassette 11.

FIG. 18 is a drawing illustrating a state after update of the kind table obtained in a case where the paper feed cassette 11 shifts from the second state to the state shown in FIG. 17 after the partial extraction of recording materials is completed.

Referring to FIGS. 17 and 18, in a case where the height L3 of the lifter 20 after the partial extraction of recording materials is lower than the height L1 of the lifter 20 corresponding to the boundary part (in the case of L2<L3<L1), the recording materials of "kind B" remains in the paper feed cassette 11, and among the recording materials housed in the paper feed cassette 11, a kind of the top recording material M is "kind B". In this case, the control part 40 determines that only part of the recording materials of "kind B" has been extracted. Consequently, the control part 40 updates "height L1 to height L2" in the amount information field associated with "kind B" of the kind table in FIG. 12 to "height L1 to height L3".

Figure 19:
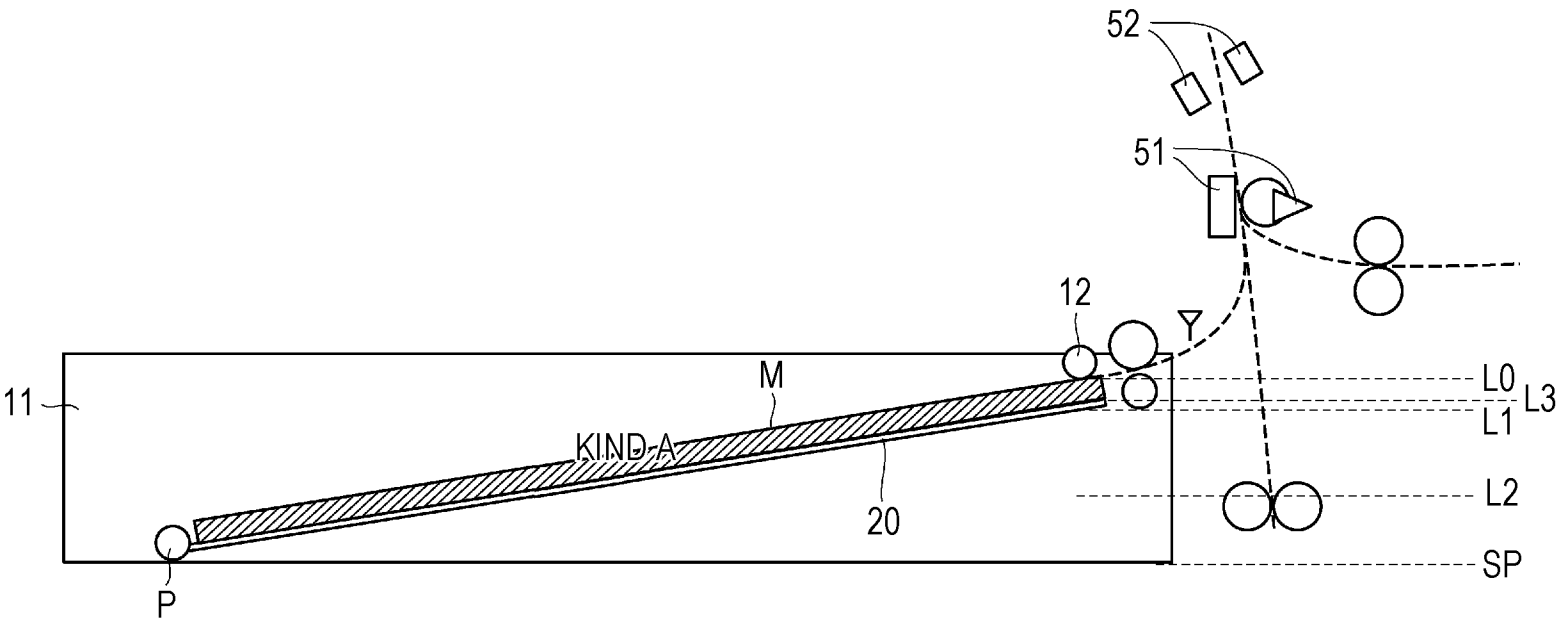
FIG. 19 is a cross-sectional view schematically illustrating another example of a state of the paper feed cassette immediately after partial extraction of recording materials has been completed from the second state in the third embodiment of the present invention.

FIG. 19 is a cross-sectional view schematically illustrating another example of a state of the paper feed cassette 11 immediately after partial extraction of recording materials has been completed from the second state in the third embodiment of the present invention. FIG. 20 is a drawing illustrating a state after update of the kind table obtained in a case where the paper feed cassette 11 shifts from the second state to the state shown in FIG. 19 after the partial extraction of recording materials is completed.

Referring to FIGS. 19 and 20, in a case where the height L3 of the lifter 20 after the partial extraction of recording materials is higher than the height L1 of the lifter 20 corresponding to the boundary part (in the case of L1<L3<L0), the recording materials of "kind B" do not remain in the paper feed cassette 11, and among the recording materials housed in the paper feed cassette 11, a kind of the top recording material M is "kind A". In this case, the control part 40 determines that all of the recording materials of "kind B" have been extracted. Consequently, the control part 40 deletes all pieces of information related to "kind B" of the kind table in FIG. 12, and updates "height L0 to height L1" in the amount information field associated with "kind A" of the kind table in FIG. 12 to "height L0 to height L3".

In a case where partial extraction of recording materials has been detected, the control part 40 identifies a kind of the top recording material housed in the paper feed cassette 11 on the basis of the kind table after update. When a print job is executed, the control part 40 transports the recording material at a speed corresponding to the kind, and performs printing under the conditions corresponding to the kind.

Fourth Embodiment

In the second state shown in FIGS. 11 and 12 (the state in which addition of recording materials of "kind B" has been detected, and consequently the kind table has been updated), there is a case where the height L of the lifter 20 detected on the basis of the output of the rotation detection sensor 23 contains a detection error (dispersion of detection). In this case, in order to correctly detect a kind of recording materials in proximity to the boundary part, the undermentioned control may be performed.

Figure 21:
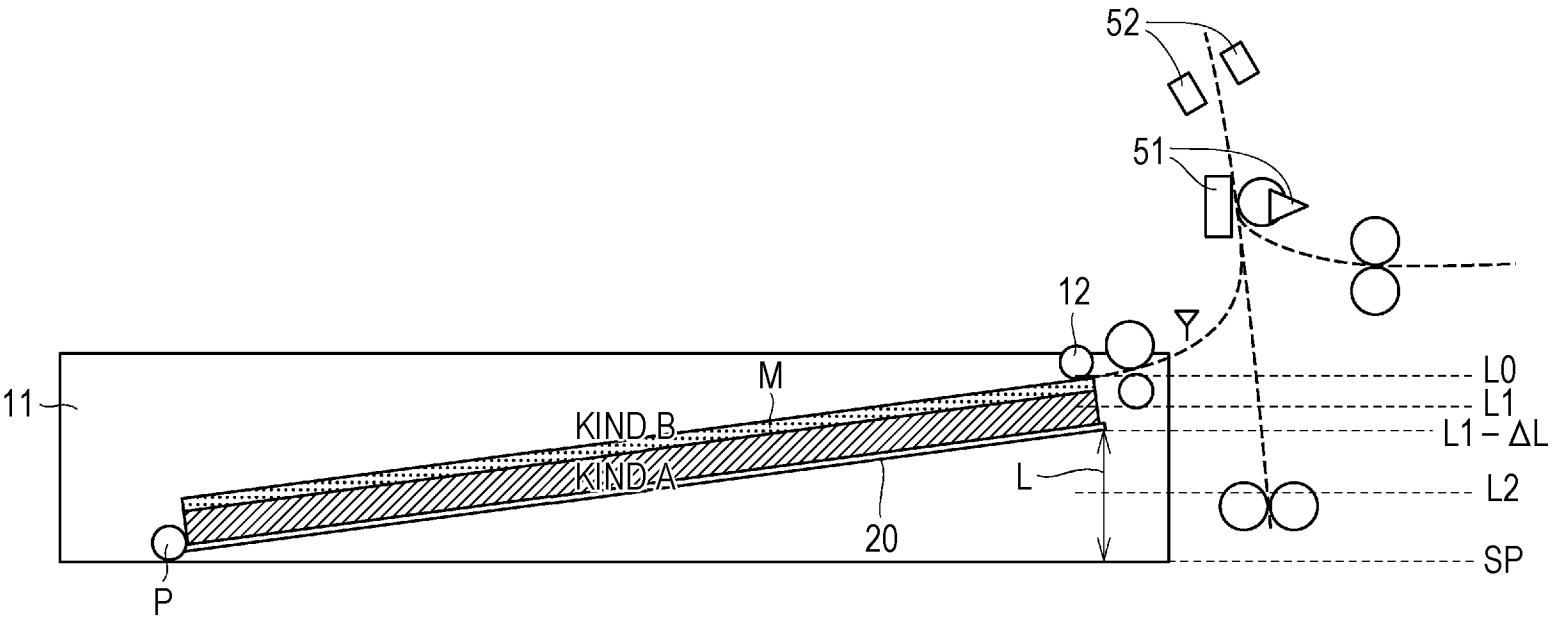
FIG. 21 is a cross-sectional view schematically illustrating a state of the paper feed cassette obtained in a case where the height L of the lifter is height ($L1-\Delta L$) in a fourth embodiment of the present invention.

FIG. 21 is a cross-sectional view schematically illustrating a state of the paper feed cassette 11 obtained in a case where the height L of the lifter 20 is height (L1−ΔL) in the fourth embodiment of the present invention.

Referring to FIG. 21, a boundary part between the recording materials M of "kind B" and the recording material M of "kind A" is a position at which the height of the lifter 20 becomes the height L1. In a case where the height L of the lifter 20 contains a detection error, it is predicted that an actual boundary part exists within a range of the height L of the lifter 20 from (L1−ΔL) to (L1+ΔL). A value ΔL is an arbitrary positive constant determined in consideration of the detection error.

Until the height L of the lifter 20 detected on the basis of the output of the rotation detection sensor 23 reaches the height (L1−ΔL) (in other words, with respect to recording materials existing in a lower part than a position at which recording materials as a target of kind detection are housed, and with respect to recording materials housed in an upper part than a detection restart position (L1−ΔL) that is away from the boundary part in the paper feed cassette 11 by a predetermined distance), the control part 40 does not detect a kind of recording materials. In a case where a print job is executed, the control part 40 determines a kind of the recording materials M housed in the paper feed cassette 11 to be "kind B" according to the kind table, transports the recording material M under transportation conditions suitable for the "kind B", and performs printing under conditions suitable for the "kind B".

When the height L of the lifter 20 detected on the basis of the output of the rotation detection sensor 23 reaches the height (L1−ΔL), the control part 40 restarts the kind detection of recording materials M when a print job is executed. Until the detected kind of recording materials M changes from "kind B" to "kind A" (in other words, from the recording material existing at the detection restart position (L1−ΔL) to the recording material, the detected kind of which agrees with the kind of the recording materials existing in the lower part than the boundary part), the control part 40 repeatedly performs the kind detection of a transported recording material.

When the detected kind of recording materials M changes from "kind B" to "kind A", the control part 40 does not detect a kind of recording material thereafter. When a print job is executed, the control part 40 transports the recording material M under transportation conditions suitable for the "kind A", and performs image forming under conditions suitable for "kind A".

Performing the above-described control enables to correctly grasp a change in kind of recording material even in a case where the detected height L of the lifter contains an error, and consequently printing can be performed under conditions suitable for the kind of recording materials.

Figure 22:
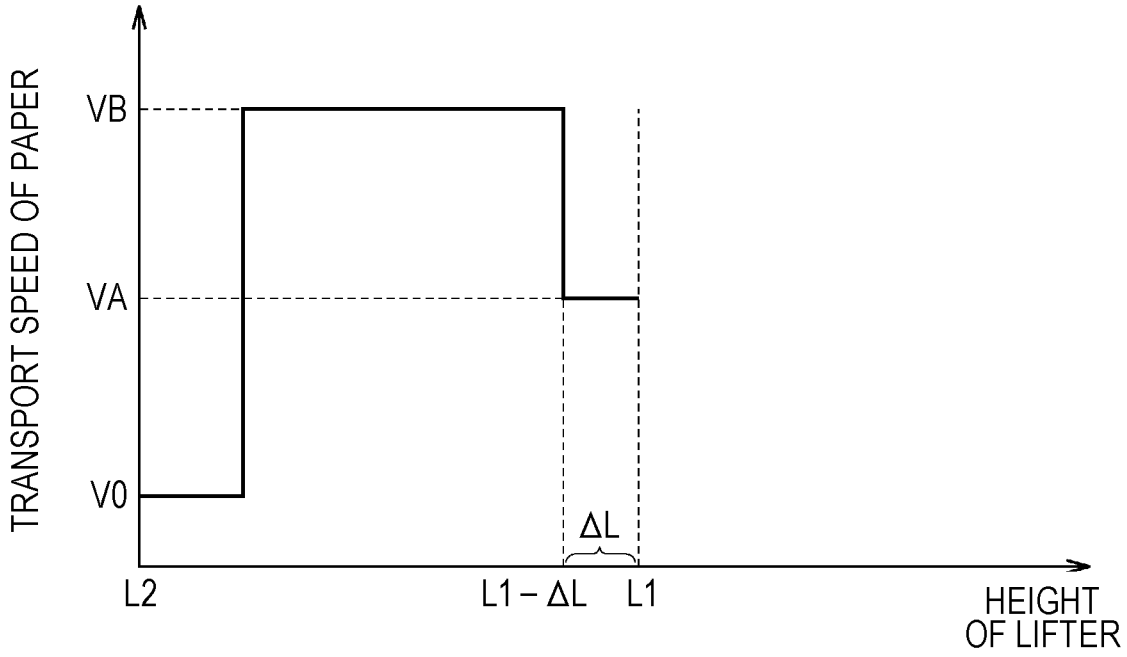
FIG. 22 is a drawing illustrating a relationship between the height of the lifter and the transport speed of a recording material according to the fourth embodiment of the present invention.

FIG. 22 is a drawing illustrating a relationship between the height of the lifter 20 and the transport speed of a recording material according to the fourth embodiment of the present invention.

Referring to FIG. 22, in a case where the above-described control is performed, when a kind of recording material M is detected in a case where the height L of the lifter 20 reaches the height (L1−ΔL), the kind of the detected recording material is either "kind A" or "kind B". Therefore, when a kind of recording material M is detected in a case where the height L of the lifter 20 reaches the height (L1−ΔL), the control part 40 sets a slower transport speed selected from between the transport speed of the recording material of "kind B" existing in the upper part than the boundary part and the transport speed of the recording material of "kind A" existing in the lower part than the boundary part (in FIG. 22, the transport speed of the recording material of "kind A"). As the result, while suppressing the occurrence of a malfunction such as an image failure, a fixing failure or a paper jam, a decrease in productivity caused by transporting recording materials at a transport speed slower than required can be suppressed.

It should be noted that in the present embodiment, as an alternative to the above-described control, all of the recording materials housed in the upper part than the boundary part among the recording materials M housed in the paper feed cassette 11 after the addition may be subjected to the kind detection of recording materials. In this case, a change in kind of recording material can be detected more correctly.

[Flowcharts]

Figure 23:
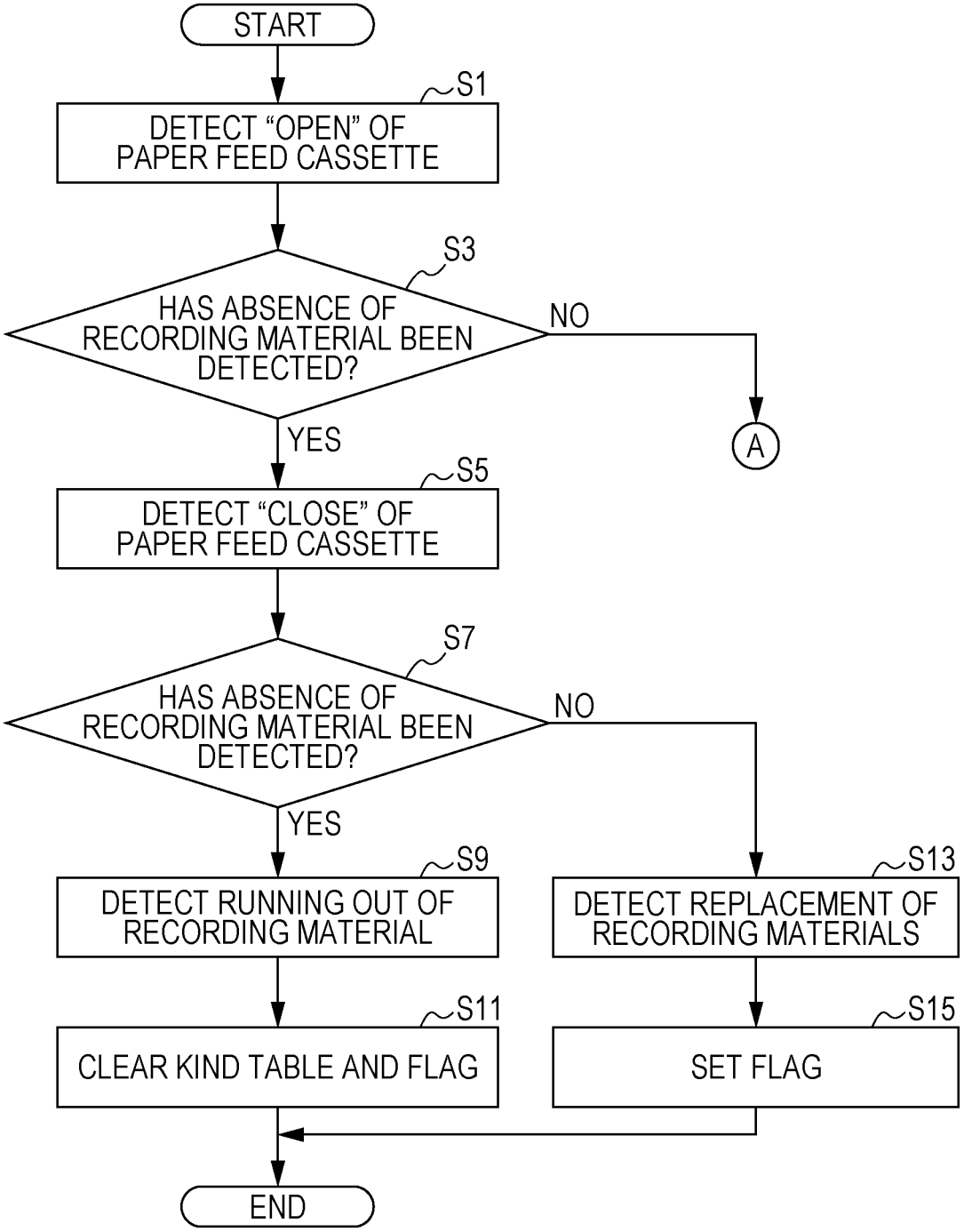
FIG. 23 is a first part of a flowchart illustrating opening and closing operation of the paper feed cassette of the image forming apparatus according to the first to third embodiments of the present invention.
Figure 24:
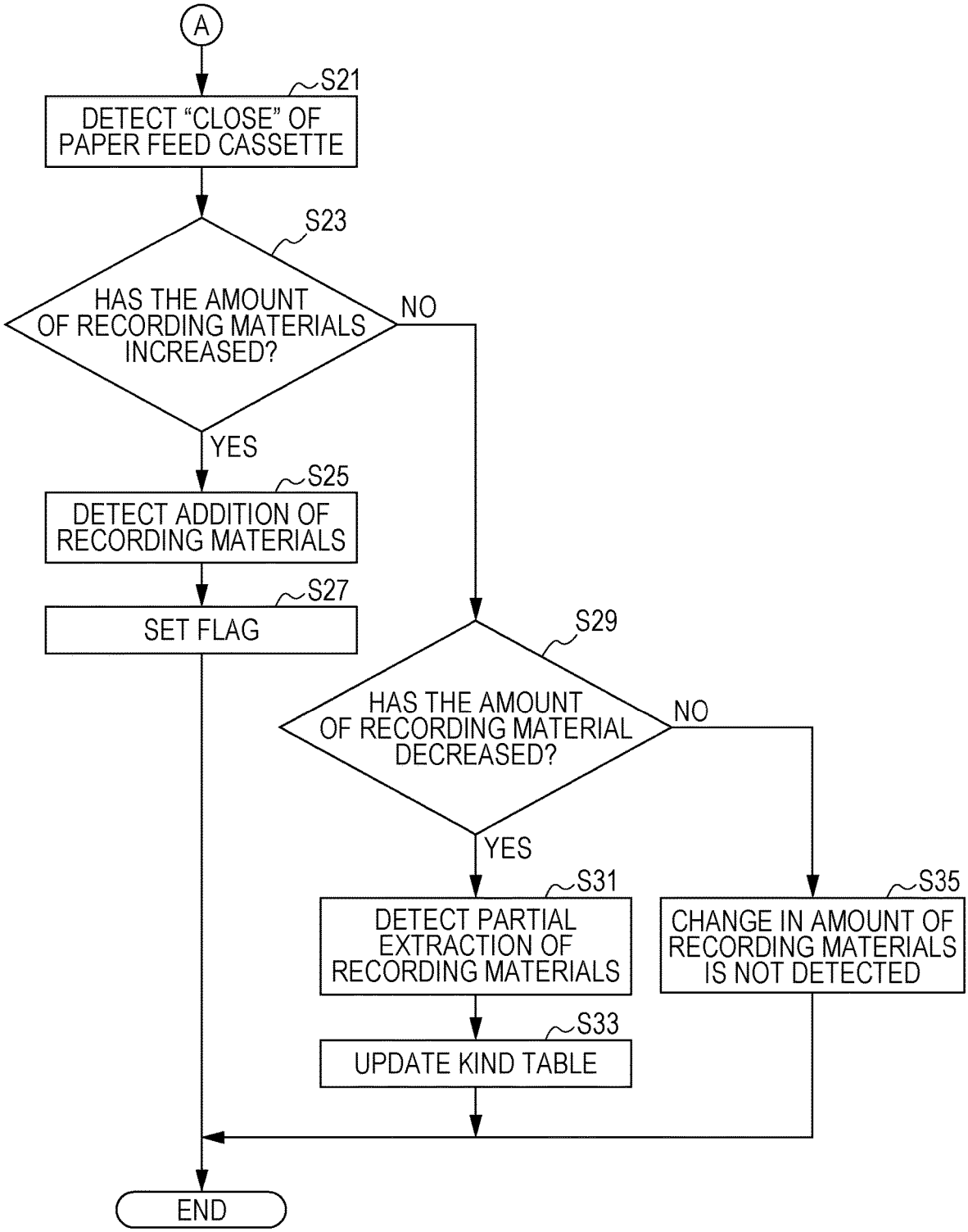
FIG. 24 is a second part of the flowchart illustrating opening and closing operation of the paper feed cassette of the image forming apparatus according to the first to third embodiments of the present invention.

FIGS. 23 and 24 are flowcharts each illustrating opening and closing operation of the paper feed cassette 11 of the image forming apparatus 1 according to the first to third embodiments of the present invention.

Referring to FIG. 23, when the opening and closing detection sensor 25 detects an opened state of the paper feed cassette 11 (Si), the control part 40 uses the recording material presence/absence detection sensor 24 to determine whether or not absence of recording material has been detected (S3).

In the step S3, in a case where it is determined that absence of recording material has not been detected (NO in S3), the control part 40 causes the process to proceed to a step S21 in FIG. 24.

In the step S3, in a case where it is determined that absence of recording material has been detected (YES in S3), the control part 40 uses the opening and closing detection sensor 25 to detect a closed state of the paper feed cassette 11 (S5), and subsequently uses the recording material presence/absence detection sensor 24 to determine whether or not absence of recording material has been detected (S7).

In the step S7, in a case where it is determined that absence of recording material has been detected (YES in S7), the control part 40 detects running out of recording material (a state in which no recording material M is housed in the paper feed cassette 11) (S9), clears the contents stored in the kind table, and a set flag (S11), and causes the process to end.

In the step S7, in a case where it is determined that absence of recording material has not been detected (NO in S7), the control part 40 detects replacement of recording materials (S13), sets a flag for performing kind detection of recording materials (S15), and causes the process to end.

Referring to FIG. 24, in a step S21, after a closed state of the paper feed cassette 11 has been detected (S21), the control part 40 determines, on the basis of the output of the rotation detection sensor 23, whether or not the amount of recording materials housed in the paper feed cassette 11 has increased before and after the opening and closing operation (S23).

In the step S23, in a case where it is determined that the amount of recording materials housed in the paper feed cassette 11 has increased before and after the opening and closing operation (YES in S23), the control part 40 detects addition of recording materials (S25), sets a flag for performing kind detection of recording materials (S27), and causes the process to end.

In the step S23, in a case where it is determined that the amount of recording materials housed in the paper feed cassette 11 has not increased before and after the opening and closing operation (NO in S23), the control part 40 determines whether or not the amount of recording materials housed in the paper feed cassette 11 has decreased before and after the opening and closing operation (S29).

In the step S29, in a case where it is determined that the amount of recording materials housed in the paper feed cassette 11 has decreased before and after the opening and closing operation (YES in S29), the control part 40 detects partial extraction of recording materials (S31). The control part 40 updates the kind table on the basis of the height of the lifter 20 after the completion of the opening and closing operation, the height having been detected on the basis of the output of the rotation detection sensor 23 (S33), and causes the process to end.

In the step S29, in a case where it is determined that the amount of recording materials housed in the paper feed cassette 11 has not decreased before and after the opening and closing operation (NO in S29), the control part 40 determines that the amount of recording materials housed in the paper feed cassette 11 has not changed before and after the opening and closing operation (S35), and causes the process to end.

Figure 25:
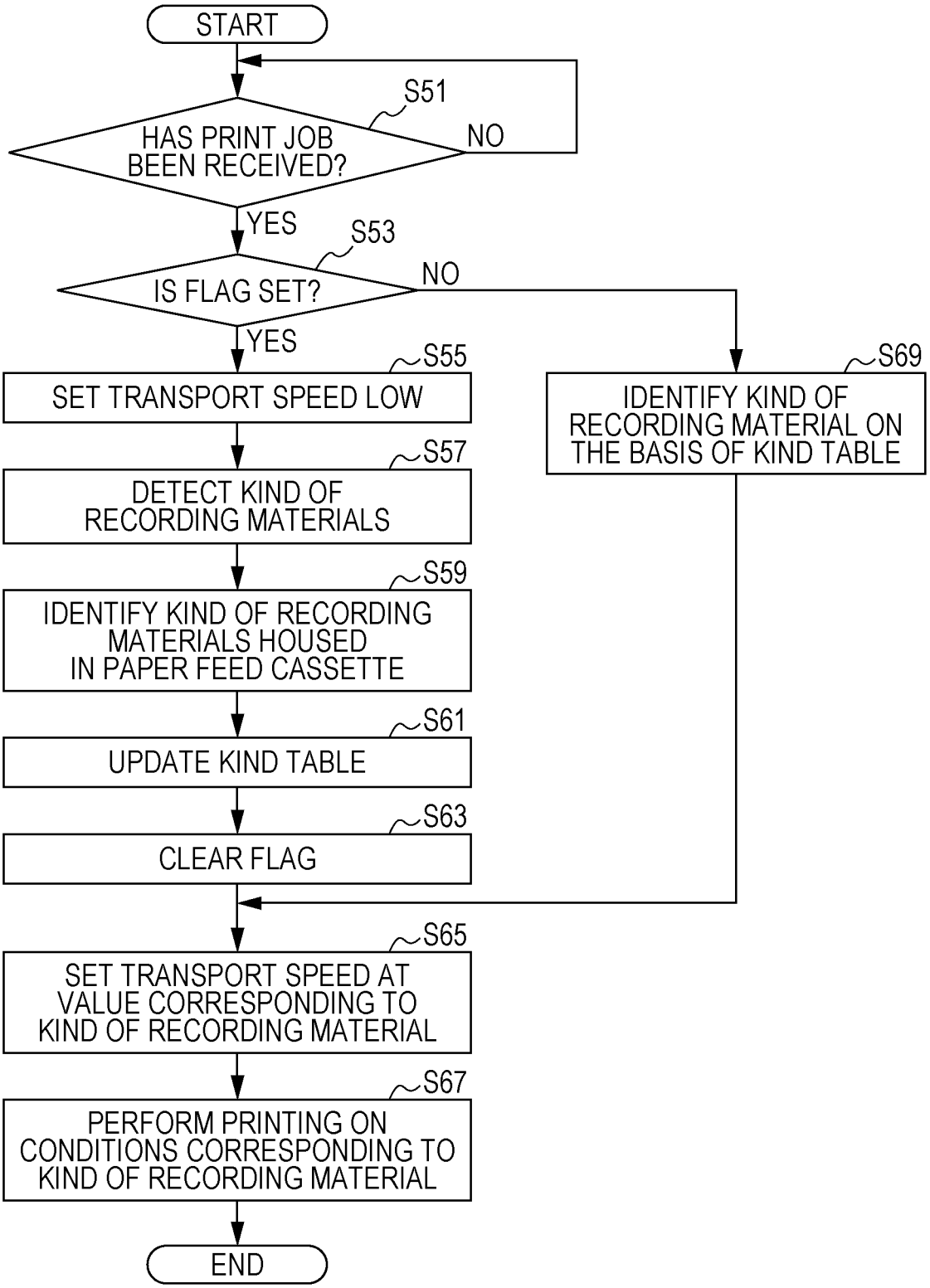
FIG. 25 is a flowchart illustrating operation at the time of executing a printing job of the image forming apparatus according to the first to third embodiments of the present invention.

FIG. 25 is a flowchart illustrating operation at the time of executing a printing job of the image forming apparatus 1 according to the first to third embodiments of the present invention.

Referring to FIG. 25, in a case where a print job has been received (YES in S51), the control part 40 determines whether or not a flag for detecting a kind of recording material is set (S53).

In the step S53, in a case where it is determined that the flag is set (YES in S53), the transport speed of the recording material up to the resist roller 14 is set low (set at a transport speed used when a kind of recording materials is detected) (S55), and a kind of recording materials is detected (S57). Next, the control part 40 identifies a kind of the recording materials housed in the paper feed cassette 11 (S59), and updates the kind table (S61). Subsequently, the control part 40 clears the flag (S63), and causes the process to proceeds to a step S65.

In the step S53, in a case where it is determined that the flag is not set (NO in S53), the control part 40 identifies a kind of the top recording material housed in the paper feed cassette 11 on the basis of the contents stored in the kind table, and the height of the lifter 20 detected on the basis of the output of the rotation detection sensor 23 (S69), and causes the process to proceeds to the step S65.

In the step S65, the control part 40 sets the transport speed at a value corresponding to a kind of a recording material that is being transported (S65). Subsequently, the control part 40 performs printing under the conditions corresponding to the kind of the recording material that is being transported (S67), and causes the process to end.

Effects of the Embodiments

According to the embodiments described above, replacement or addition of recording materials is detected, and on the basis of the result of the detection, whether or not to detect a kind of recording materials can be switched. Consequently, in a case where replacement or addition of recording materials has been performed, the recording materials can be detected without requiring user's operation. As the result, while avoiding complication of user's operation, a kind of recording materials can be correctly detected. In addition, printing can be performed under the most suitable conditions corresponding to the kind of recording materials, and consequently an excellent image can be obtained. Moreover, a decrease in productivity (such as the first printing time and throughput) caused by the kind detection of recording materials can be suppressed.

[Others]

While the power supply to the image forming apparatus 1 is stopped, or while the image forming apparatus 1 is in a sleep state (power saving state), it is predicted that it is not possible to perform the detection of presence/absence of recording materials housed in the paper feed cassette 11 by the recording material presence/absence detection sensor 24, and the detection of opening and closing of the paper feed cassette 11 by the opening and closing detection sensor 25. It is preferable that a kind of recording materials be properly detected even in a case where replacement and addition of recording materials is performed during the above time period. Whether or not to detect a kind of recording materials may be switched on the basis of at least one of the sameness between the height of the lifter 20 detected immediately before the power supply to the image forming apparatus 1 is stopped and the height of the lifter 20 detected immediately after the power is supplied, and the sameness between the height of the lifter 20 detected immediately before the image forming apparatus 1 shifts to a sleep state and the height of the lifter 20 detected immediately after the image forming apparatus 1 returns from the sleep state.

More specifically, in the first state, in a case where the heights of the lifter 20 detected before and after the power supply to the image forming apparatus 1 is stopped is the same, or in a case where the heights of the lifter 20 detected before and after the image forming apparatus 1 shifts to the sleep state is the same, the control part 40 does not detect replacement or addition of recording materials, and does not have to detect a kind of recording materials. In this case, the control part 40 performs printing suitable for conditions of the recording material of "kind A" according to the kind table.

In addition, in a case where the heights of the lifter 20 detected before and after the power supply to the image forming apparatus 1 is stopped differ from each other, or in a case where the heights of the lifter 20 detected before and after the image forming apparatus 1 shifts to the sleep state differ from each other, when a higher priority is given to the accuracy of kind detection of recording material, the control part 40 may be adapted to detect replacement or addition of recording materials, and when a print job is executed, all of the recording materials housed in the paper feed cassette 11 may be subjected to the kind detection of recording materials. Moreover, when importance is attached to productivity, only a first sheet of recording material at the time of the execution of a print job may be subjected to the kind detection of recording material, and printing on second and subsequent sheets of recording materials may be performed under the same conditions as those for the kind of the first sheet of recording material.

The housing part according to the embodiments of the present invention has only to be capable of housing a plurality of recording materials in such a manner that one recording material is put on another. For example, as with the manual feed tray 17, the housing part does not have to include a mechanism that switches between an opened state and a closed state. In this case, an amount detector that detects the amount of recording materials housed on the manual feed tray 17 is provided, and replacement or addition of recording materials housed on the manual feed tray 17 is detected on the basis of a result of detection by the amount detector. More specifically, after absence of recording material is detected by the recording material presence/absence detection sensor provided on the manual feed tray 17, in a case where the recording material presence/absence detection sensor detects presence of recording material, the control part 40 determines that the manual feed tray 17 has been replenished with new recording materials after recording materials housed on the manual feed tray 17 have run out once. Consequently, the control part 40 may detect replacement of recording materials or addition of recording materials.

The above-described embodiments can be combined as appropriate.

The processing in the above embodiments may be carried out by software or by using hardware circuitry. In addition, a program that executes the processing in the above embodiments may be provided, or the program may be recorded on a recording medium such as a CD-ROM, a flexible disk, a hard disk, a ROM, a RAM, and a memory card so as to provide the recording medium to a user. The program is executed by a computer such as a CPU. Moreover, the program may be downloaded to a device through a communication line such as Internet.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus with switchable paper kind detection, the image forming apparatus comprising:

a housing part that is capable of housing a plurality of recording materials in such a manner that one recording material is put on another;

a transport part that transports a recording material from the housing part; and hardware sensors and a hardware processor that:

detect a kind of the recording material transported by the transport part, detect an amount of the recording materials housed in the housing part, detect replacement of recording materials housed in the housing part, or addition of recording materials in the housing part, based on a result of the detection by the hardware sensors and the hardware processor of the amount of recording materials housed in the housing part, and, based on a result of the detection by the hardware sensors and the hardware processor of the replacement of the recording materials or the addition of recording materials, switches whether or not to execute, by the hardware sensors and the hardware processor, the kind detection of the recording materials housed in the housing part.

2. The image forming apparatus according to claim 1, wherein in a case where replacement or addition of recording materials has been detected by the hardware sensors and the hardware processor, the hardware sensors and the hardware processor identify a kind of recording materials housed in the housing part based on the basis of a result of the detection by the hardware sensors and the hardware processor and the hardware processor stores information related to the kind identified by the hardware sensors and the hardware processor.

3. The image forming apparatus according to claim 2, wherein after absence of recording material has been detected by the hardware sensors, in a case where presence of recording material has been detected by the hardware sensors, the hardware sensors and the hardware processor detect replacement of recording materials.

4. The image forming apparatus according to claim 2, wherein the housing part changes between an opened state in which a recording material can be put in and out, and a closed state in which the recording material cannot be put in and out, the image forming apparatus further comprises an opening and closing detector that detects the opened state and the closed state of the housing part, and based on detection results from the hardware sensors and the hardware processor before and after the opening and closing operation in which the housing part changes from the closed state to the opened state, and changes from the opened state to the closed state again, the hardware sensors and the hardware processor detect replacement of recording materials housed in the housing part, or addition of recording materials in the housing part.

5. The image forming apparatus according to claim 4, wherein in a case where absence of recording material has been detected by the hardware sensors in a state in which the opening and closing detector is detecting the opened state during the opening and closing operation, and subsequently presence of recording material has been detected by the hardware sensors after the completion of the opening and closing operation, the hardware sensors and the hardware processor detect replacement of recording materials.

6. The image forming apparatus according to claim 4, wherein in a case where replacement of recording materials has been detected by the hardware sensors and the hardware processor, the hardware sensors and the hardware processor detect, by the hardware sensors and the hardware processor, a kind of a first number of sheets of recording materials transported earlier among recording materials housed in the housing part after the replacement, and do not detect, by the hardware sensors and the hardware processor, a kind of recording materials transported after the first number of sheets of recording materials among recording materials housed in the housing part after the replacement, and in a case where replacement of recording materials has been detected by the hardware sensors and the hardware processor, the hardware sensors and the hardware processor identify a kind of all of the recording materials housed in the housing part after the replacement as the kind of the first number of sheets of recording materials detected by the hardware sensors and the hardware processor.

7. The image forming apparatus according to claim 4, wherein in a case where the hardware sensors have not detected absence of recording material during the opening and closing operation, and have detected an increase in amount of recording materials before and after the opening and closing operation, the hardware sensors and the hardware processor detect addition of recording materials.

8. The image forming apparatus according to claim 7, wherein in a case where addition of recording materials has been detected by the hardware sensors, the hardware sensors and the hardware processor detect, by the hardware sensors and the hardware processor, a kind of a second number of sheets of recording materials transported earlier among recording materials housed in the housing part after the replacement, and the hardware processor, in a case where addition of recording materials has been detected by the hardware sensors and the hardware processor, calculates a boundary part of the addition of the recording materials on the basis of a result of the detection by the hardware sensors and the hardware processor before the opening and closing operation.

9. The image forming apparatus according to claim 8, wherein in a case where addition of recording materials has been detected by the hardware sensors and the hardware processor, the hardware sensors and the hardware processor do not detect, by the hardware sensors and the hardware processor, a kind of recording materials that are housed after the second number of sheets of recording materials, and are housed on the upper side than the boundary part in the housing part, among recording materials housed in the housing part after the addition, and the hardware sensors and the hardware processor identify the kind of the second number of sheets of recording materials detected by the hardware sensors and the hardware processor as a kind of the recording materials housed on the upper side than the boundary part.

10. The image forming apparatus according to claim 9, wherein in a case where the kind of the recording materials housed in an upper part than the boundary part, the kind having been identified by the hardware sensors and the hardware processor, is the same as the kind stored in the hardware processor before the addition of recording materials is detected by the hardware sensors and the hardware processor, the hardware processor stores the recording materials housed in the upper part than the boundary part, and the recording materials housed in a lower part than the boundary part, as the same kind of recording materials.

11. The image forming apparatus according to claim 10, wherein in a case where the kind of the recording materials housed in the upper part than the boundary part, the kind having been identified by the hardware sensors and the hardware processor, is the same as the kind stored in the hardware processor before the addition of recording materials is detected by the hardware sensors and the hardware processor, the hardware sensors and the hardware processor do not detect, by the hardware sensors and the hardware processor, a kind of recording materials after the second number of sheets of recording materials among recording materials housed in the housing part after the addition.

12. The image forming apparatus according to claim 8, further comprising a warning part that, in a case where the kind of the recording materials housed in an upper part than the boundary part, the kind having been identified by the hardware sensors and the hardware processor, differs from the kind stored in the hardware processor before the addition of recording materials is detected by the hardware sensors and the hardware processor, warns that a different kind of recording materials have been added.

13. The image forming apparatus according to claim 8, wherein the hardware sensors and the hardware processor detects the kind, by the hardware sensors and the hardware processor, all of the recording materials housed in an upper part than the boundary part among recording materials housed in the housing part after the addition.

14. The image forming apparatus according to claim 8, wherein the hardware sensors and the hardware processor do not detect, by the hardware sensors and the hardware processor, a kind of recording materials housed in a lower part than the boundary part among recording materials housed in the housing part after the addition.

15. The image forming apparatus according to claim 8, wherein in a case where addition of recording materials has been detected by the hardware sensors and the hardware processor, the hardware sensors and the hardware processor do not detect, by the hardware sensors and the hardware processor, a kind of recording materials that exist in a lower part than a position at which the second number of sheets of recording materials are housed, and that are housed in an upper part than a predetermined position, the predetermined position being away from the boundary part in the housing part by the predetermined distance, among recording materials housed in the housing part after the addition, and the hardware sensors and the hardware processor perform kind detection, by the hardware sensors and the hardware processor, from a recording material existing at the detection restart position in the housing part up to a recording material, the detected kind of which agrees with the kind of the recording materials existing in the lower part than the boundary part.

16. The image forming apparatus according to claim 15, wherein the hardware processor restarts the detection by the hardware sensors and the hardware processor from a recording material existing at the predetermined position, and after the detection by the hardware sensors and the hardware processor is restarted, up to a recording material, the detected kind of which agrees with the kind of the recording materials existing in the lower part than the boundary part, the transport part transports recording materials at a slower transport speed selected from between a transport speed of the recording materials existing in the upper part than the boundary part, and a transport speed of the recording materials existing in the lower part than the boundary part.

17. The image forming apparatus according to claim 8, further comprising a display part that displays at least one of pieces of information of: the boundary part; the kind of recording materials identified by the hardware sensors and the hardware processor; and the amount of recording materials detected by the hardware sensors and the hardware processor.

18. The image forming apparatus according to claim 4, wherein in a case where the hardware sensors have not detected absence of recording material during the opening and closing operation, and have detected that the amount of recording materials is the same before and after the opening and closing operation, the hardware sensors and the hardware processor do not detect replacement and addition of recording materials, and the hardware sensors and the hardware processor do not perform, by the hardware sensors and the hardware processor, kind detection of the recording materials housed in the housing part.

19. The image forming apparatus according to claim 4, wherein in a case where the hardware sensors have not detected absence of recording material during the opening and closing operation, and have detected a decrease in amount of recording materials before and after the opening and closing operation, the hardware sensors and the hardware processor further detect partial extraction of recording materials.

20. The image forming apparatus according to claim 19, wherein in a case where partial extraction of recording materials has been detected by the hardware sensors and the hardware processor, the transport part transports recording materials at a transport speed corresponding to a kind of a top recording material housed in the housing part on the basis of information stored in the hardware processor, and the result of the detection by the hardware sensors and the hardware processor.

21. The image forming apparatus according to claim 2, further comprising a printing part that performs printing on a recording material transported by the transport part under conditions corresponding to the kind identified by the hardware sensors and the hardware processor.

22. The image forming apparatus according to claim 1, wherein the hardware sensors and the hardware processor detect the amount of recording materials housed in the housing part based on at least one of: a moving distance of a lifter for lifting recording materials housed in the housing part; a current value of a motor for driving the lifter; the time required to lift the recording materials by the lifter; an image taken inside the housing part; and a rotational amount until the motor for driving the lifter completes lifting.

23. The image forming apparatus according to claim 1, wherein the hardware sensors and the hardware processor detect replacement of recording materials housed in the housing part, or addition of recording materials in the housing part, based on at least one of sameness between a result of detection by the hardware sensors immediately before power supply to the image forming apparatus is stopped and a result of detection by the hardware sensors immediately after the power is supplied, and sameness between a result of detection by the hardware sensors immediately before the image forming apparatus shifts to a sleep state and a result of detection by the hardware sensors immediately after the image forming apparatus returns from the sleep state.

24. A method for controlling an image forming apparatus including:

a housing part that is capable of housing a plurality of recording materials in such a manner that one recording material is put on another;

a transport part that transports a recording material from the housing part; and hardware sensors and a hardware processor that detect a kind of the recording material transported by the transport part, and detect an amount of the recording materials housed in the housing part, the method comprising:

detecting replacement of recording materials housed in the housing part, or addition of recording materials in the housing part, on the basis of a result of the detection by the hardware sensors and the hardware processor of the amount of the recording materials: and controlling, based on a result of the detecting replacement of recording materials or addition of recording materials, to switch whether or not to execute, by the hardware sensors and the hardware processor, a kind detection of the recording materials housed in the housing part.

* * * * *